US008472850B2

(12) United States Patent
Kawano et al.

(10) Patent No.: US 8,472,850 B2
(45) Date of Patent: Jun. 25, 2013

(54) IMAGE FORMING DEVICE AND DEVELOPING DEVICE

(75) Inventors: Masahiro Kawano, Tokyo (JP); Atsushi Ohta, Tokyo (JP); Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 305 days.

(21) Appl. No.: 12/862,055

(22) Filed: Aug. 24, 2010

(65) Prior Publication Data

US 2011/0052273 A1 Mar. 3, 2011

(30) Foreign Application Priority Data

Aug. 28, 2009 (JP) ..... 2009-197668

(51) Int. Cl.
*G03G 15/08* (2006.01)

(52) U.S. Cl.
USPC ..... 399/281; 399/265; 399/279

(58) Field of Classification Search
USPC ..... 399/265, 279, 281
See application file for complete search history.

(56) References Cited

U.S. PATENT DOCUMENTS

2009/0003850 A1* 1/2009 Yamamoto et al. ..... 399/27

FOREIGN PATENT DOCUMENTS

| | | |
|---|---|---|
| JP | A-2000-098737 | 4/2000 |
| JP | A-2001-092248 | 4/2001 |
| JP | A-2003-215923 | 7/2003 |
| JP | 2005-148664 A | 6/2005 |

* cited by examiner

*Primary Examiner* — Ryan Walsh
(74) *Attorney, Agent, or Firm* — Posz Law Group, PLC

(57) ABSTRACT

A developing device that is provided in an image forming device that forms an image includes an image carrier on which an electrostatic latent image is formed; a developer carrier that forms a developer image on a surface of the image carrier by attaching a developer on the electrostatic latent image; a supplying member that supplies the developer to the developer carrier by contacting the developer carrier, and that scrapes the developer remaining on the surface of the developer carrier from the developer carrier, and a deformation amount between the developer carrier and the supplying member is individually configured corresponding to a location where the developing device is provided in the image forming device.

5 Claims, 11 Drawing Sheets

| Developing Device | Experimental Example 1 | | Experimental Example 2 | | Experimental Example 3 | |
|---|---|---|---|---|---|---|
| | Def. Amount (mm) | Conta minant | Def. Amount (mm) | Conta minant | Def. Amount (mm) | Conta minant |
| Black (K) | 0.65 | fine | 0.95 | fine | 0.65 | fine |
| Cyan (C) | 0.65 | fine | 0.95 | fine | 0.65 | fine |
| Magenta (M) | 0.65 | fine | 0.95 | fine | 0.65 | fine |
| Yellow (Y) | 0.65 | fault | 0.95 | fine | 0.95 | fine |

Fig. 8A

| Developing Device | Experimental Example 4 | | Experimental Example 5 | | Experimental Example 6 | |
|---|---|---|---|---|---|---|
| | Def. Amount (mm) | Conta minant | Def. Amount (mm) | Conta minant | Def. Amount (mm) | Conta minant |
| Black (K) | 0.63 | fine | 0.6 | fine | 0.6 | fine |
| Cyan (C) | 0.63 | fine | 0.6 | fine | 0.63 | fine |
| Magenta (M) | 0.63 | fine | 0.65 | fine | 0.65 | fine |
| Yellow (Y) | 0.95 | fine | 0.95 | fine | 0.95 | fine |

Fig. 8B

| Developing Device | Experimental Example 1 | | | Experimental Example 2 | | | Experimental Example 3 | | |
|---|---|---|---|---|---|---|---|---|---|
| | Bent R (mm) | Contaminant | Density | Bent R (mm) | Contaminant | Density | Bent R (mm) | Contaminant | Density |
| Black (K) | 0.23 | fault | fine | 0.18 | fine | fine | 0.18 | fine | fine |
| Cyan (C) | 0.23 | fine | fine | 0.18 | fine | fault | 0.23 | fine | fine |
| Magenta (M) | 0.23 | fine | fine | 0.18 | fine | fault | 0.23 | fine | fine |
| Yellow (Y) | 0.23 | fine | fine | 0.18 | fine | fault | 0.23 | fine | fine |

Fig. 11

IMAGE FORMING DEVICE AND DEVELOPING DEVICE

CROSS REFERENCE

The present application is related to, claims priority from and incorporates by reference Japanese patent application number 2009-197668, filed on Aug. 28, 2009.

TECHNICAL FIELD

The present invention relates to an image forming device that forms an image by an electrophotographic process, and relates to a developing device that is used for the image forming device.

BACKGROUND

A printer, facsimile, photocopier, and a multi function peripheral (MFP) having these three functions or the like are used as an image forming device that forms an image by an electrophotographic process.

Such an image forming device provides a developing device, an exposing device, a transferring mechanism and a fusing device. The developing device forms a developer image on a surface of a photosensitive drum, which will be described below, by a developer. The exposing device exposes the photosensitive drum, which will be described below, and forms an electrostatic latent image, which will be described below, on the surface of the photosensitive drum. The transferring mechanism transfers the developer image formed on the surface of the photosensitive drum to a transfer medium. Additionally, the "transfer medium" means a medium on which the developer image described below is transferred, and means a recording medium such as paper and a transferring belt. The fusing device fuses the developer image transferred on the recording medium on the recording medium.

In the developing device, configuring elements such as a toner cartridge, a toner supply roller, a photosensitive drum, a charge roller, a developing roller, a developing blade, a cleaning blade are integrated. The developing device is configured in a detachable manner with respect to the image forming device. Some developing devices provide a detachable toner cartridge.

Some of the conventional image forming devices provide an elastic layer of the toner supply roller that is formed in foam structure having a number of apertures, which is referred to as a "cell," so as to efficiently supply the toner to the developing roller and/or to efficiently clean (scrape) residual developing toner from the developing roller. See Japanese laid-open patent application publication number 2005-148664.

In the conventional image forming device, in order that the elastic layer of the developing roller is deformed into the elastic layer of the toner supply roller, the distance between the rotation axis of the developing roller and the rotation axis of the toner supply roller (hereafter referred to as an "inter-axial distance") is configured smaller than the sum of the radius of the developing roller and the radius of the toner supply roller. Namely, the conventional image forming device has a configuration of squeezing the developing roller and the toner supply roller in a smaller distance than the sum of the radius of the developing roller and the radius of the toner supply roller.

Such conventional image forming devices are configured to adjust a supplying-ability of the toner to the developing roller and a cleaning (or scraping)-ability of the residual developing toner from the developing roller by arbitrarily designing a deformation amount between the developing roller and the toner supply roller, the shape of the cell of the toner supply roller, the radius of the cell, the thickness of the cell wall, etc. Additionally, the "deformation amount" means an amount of how much a hard member (herein, the developing roller) deforms a soft member (herein, the toner supply roller) when the two rollers are squeezed in a frame shorter than the interaxial distance.

The conventional image forming device often provides a plurality of developing devices corresponding to colorization. However, when the conventional image forming device is designed, it is not considered that toner contained in each developing device is transformed due to heat from a fusing device that functions as a heat source so that a variation of adhering force occurs: a variation of a charging characteristics occurs depending on colors of the toners. Thereby, the conventional image forming device occasionally fails to properly scrape the residual developing toner in the developing device that is closely positioned to the fusing device as a heat source and/or in which highly charged toner is used due to the above variations.

Additionally, there is another problem that downsizing is prevented when the conventional image forming device is designed to suppress the failures of scraping the residual developing toner.

Namely, in order to suppress the failures of cleaning the residual developing toner in the conventional image forming device, the deformation amount between the developing roller and the toner supply roller of all of the developing devices and/or the deformation amount between the developing roller and the developing blade of all of the developing device etc. are increased in all of the developing devices. However, a large amount of load torque is required to rotate the developing roller and the toner supply roller of all of the developing devices for suppressing the above failures. Therefore, the conventional image forming device requires a high-output motor. As a result, the conventional image forming device is relatively large sized and is prevented from downsizing.

SUMMARY OF THE INVENTION

In order to achieve the above objects, a developing device of the present application that is provided in an image forming device that forms an image includes an image carrier on which an electrostatic latent image is formed; a developer carrier that forms a developer image on a surface of the image carrier by attaching a developer on the electrostatic latent image; a supplying member that supplies the developer to the developer carrier by contacting the developer carrier, and that scrapes the developer remaining on the surface of the developer carrier from the developer carrier, and a deformation amount between the developer carrier and the supplying member is individually configured corresponding to a location where the developing device is provided in the image forming device.

Also, an image forming device of the present application includes the developing device described above.

Also, another developing device of the present application that is provided in an image forming device that forms an image includes an image carrier on which an electrostatic latent image is formed; a developer carrier that forms a developer image on a surface of the image carrier by attaching a developer on the electrostatic latent image; a supplying member that supplies the developer to the developer carrier by contacting the developer carrier, and that scrapes the developer remaining on the surface of the developer carrier from the developer carrier; a layer regulating member that contacts the developer carrier and that regulates a layer thickness of the developer supplied to the developer carrier by the supplying member; and a contact pressure per unit area where the layer regulating member contacts the developer carrier, the contact pressure per unit area being individually configured corresponding to a charging characteristics of the developer to be used.

Another image forming device of the present invention includes the developing device described above.

According to the above invention, an image forming device that suppresses failures of scraping the residual developing toner can be provided without preventing from downsizing the image forming device. Further, a developing device used for the image forming device of the invention can be provided.

BRIEF DESCRIPTION OF THE DRAWINGS

FIG. 8A illustrates experimental examples according to the embodiment 1. FIG. 8B illustrates other experimental examples.

FIG. 11 illustrates experimental examples according to the embodiment 2.

DETAILED DESCRIPTION OF EMBODIMENTS

Figure 1:
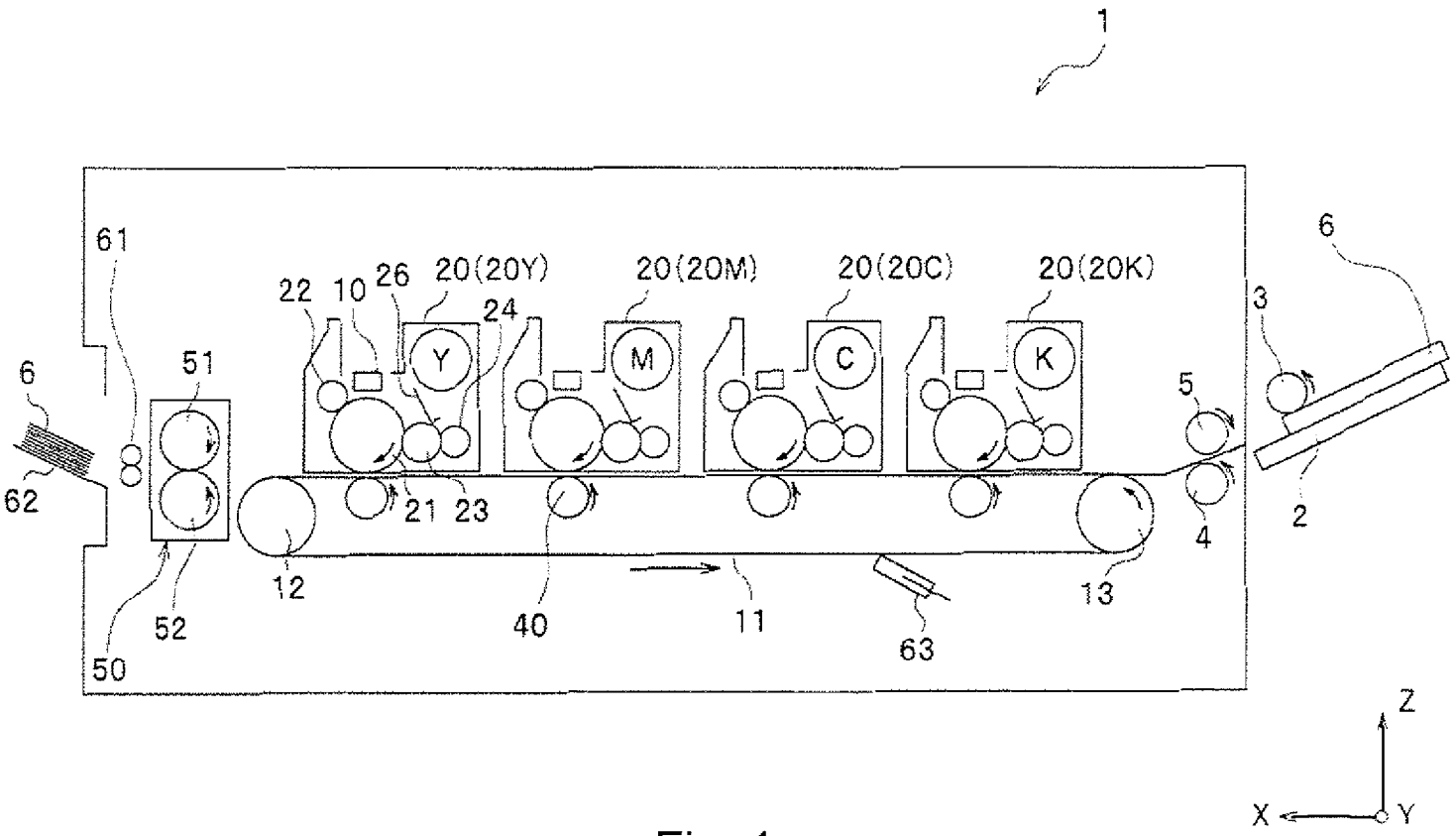
FIG. 1 illustrates a configuration of an image forming device according to an embodiment 1.

Hereafter, detailed descriptions will be given regarding embodiments of the present invention (hereafter referred to as "present embodiment") referring to the drawings. Each drawing is schematically illustrated enough to sufficiently understand the present invention. The present invention is not limited to the illustrated examples. In each of the drawings, corresponding configuring elements and similar configuring elements have the same reference numbers, and the overlapped descriptions thereof are omitted.

Embodiment 1

The characteristics of the present embodiment 1 is that a deformation amount of a developing device 20 between a developing roller of a developer carrier and a toner supply roller of a supplying member is individually configured to be larger as the developing device 20 is closer to a fusing device (as a fusing part) corresponding to a distance from the fusing device to be heat source.

Figure 12:
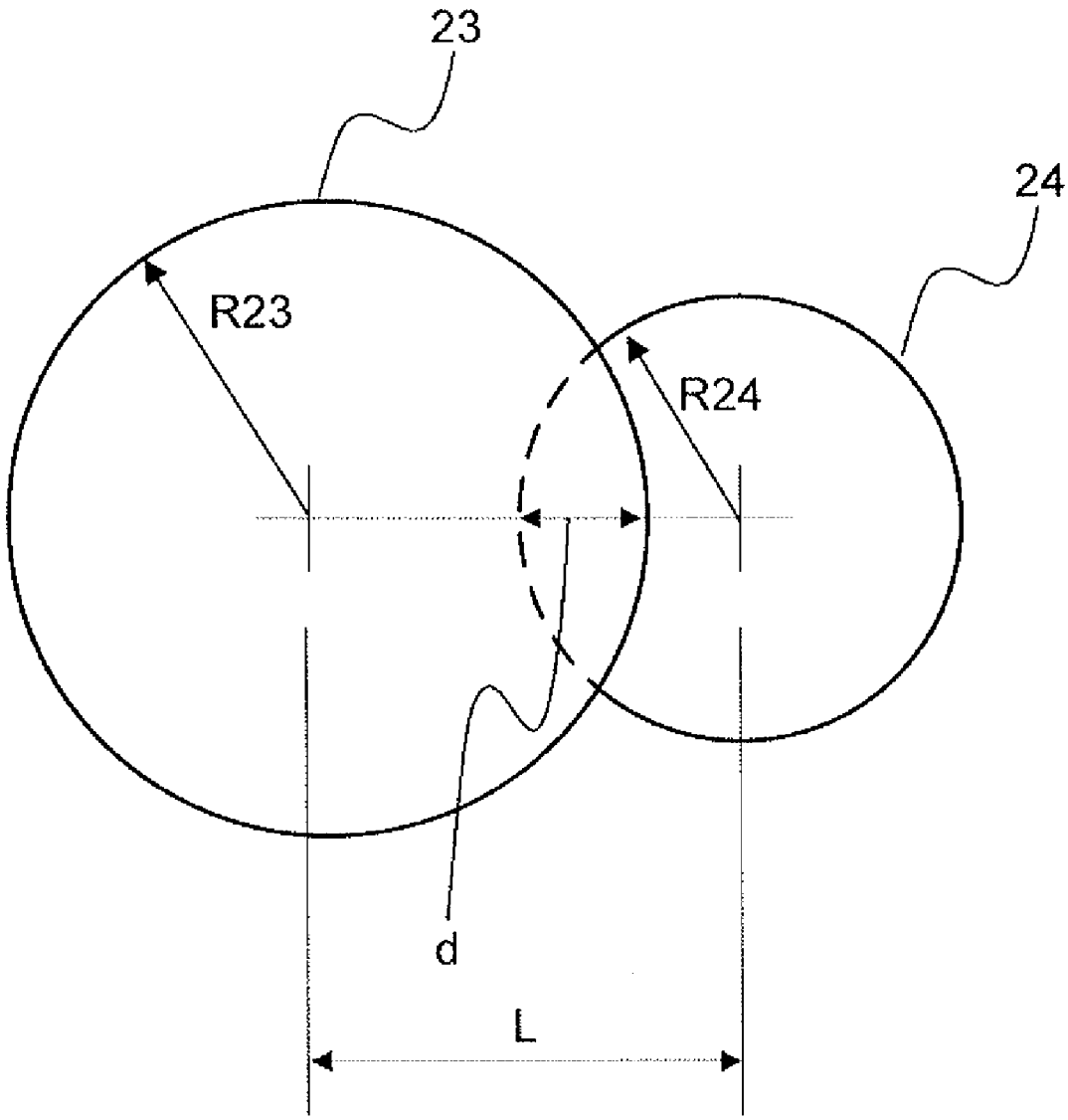
FIG. 12 illustrates a definition of the deformed amount.

In the application, the deformation amount d is determined, for example, by how much the developing roller 23 is deformed against the toner supply roller 20. Referring to FIG. 12, the deformation amount d is defined by:

$$d=R23+R24-L$$

where the numeral "L" represents a distance between axes of the developing roller 20 and toner supply roller 23, "R23" represents a radius of the developing roller 23, "R24" represents a radius of the toner supply roller 24.

Specifically, in the present embodiment 1, at least the deformation amount (first deformation amount) of the closest developing device (first developing device) to the fusing device is set to be larger than the deformation amount (second deformation amount) of the developing device (second developing device) that is farthest (or most distantly positioned) from the fusing device.

(Configuration of image forming device) Hereafter, descriptions are given regarding a configuration of an image forming device according to the present embodiment 1. FIG. 1 is a drawing illustrating the configuration of the image forming device according to the embodiment 1. Herein, as an example of the image forming device, a color printer of an electrographic system using four developing devices corresponding to each of colors such as black(K), cyan(C), magenta(M) and yellow(Y) is used. The image forming device is not limited to this color printer, and a device using a plurality of developing devices shall be fine.

Regarding the X-Y-Z coordinates of FIG. 1, the x-axis indicates a carrying direction of a recording medium 6 by a transferring belt 11, which will be described later, the y-axis indicates a rotation axis direction of a photosensitive drum 21, which will be described later, and the z-axis indicates a direction orthogonal to both of these axes.

As illustrated in FIG. 1, an image forming device 1 provides a sheet cassette 2, a hopping roller 3, a pinch roller 4, a registration roller 5, exposing devices 10, a transferring belt 11, developing devices 20, transferring rollers 40 as a transferring mechanism (or a transfer part), a fusing device 50, an ejecting roller 61 and a stacker part 62.

The sheet cassette 2 is a container for containing a recording medium 6 such as paper, etc. in a stacked condition. In the illustrated example, the sheet cassette 2 is provided outside of the image forming device 1 in a protruded manner. The hopping roller 3 is a member for separating the recording medium 6 in the sheet cassette 2 one by one and for feeding the medium to the downstream side of a carrying direction.

The pinch roller 4 is a member for feeding the recording medium 6 to the downstream side of the carrying direction. The registration roller 5 is a member for adjusting an incline of the recording medium 6 with the pinch roller 4. The registration roller 5 is provided facing the pinch roller 4, and is biased on the side of the pinch roller 4 by a biasing method, which is not illustrated. The pinch roller 4 and the registration roller 5 carry the recording medium 6 that is fed from the sheet cassette 2 to a developing device 20K, which will be described later.

The exposing device 10 exposes a photosensitive drum 21, which will be described later, of the developing devices 20 and forms an electrostatic latent image on a surface of the photosensitive drum 21. The exposing device 10 is provided between a charge roller 22 and a developing roller 23 (see FIG. 2) in the periphery of the photosensitive drum 21.

The exposing device 10 is configured with a light emitting element array where a number of light emitting elements such as LED, etc., are arranged. The exposing device 10 selectively makes each of the light emitting elements emit light when a print control part 71 and an exposing control part 83 (see FIG. 3) output a light emitting order based on the print data. The exposing device 10 provides a rod lens array for converging light generated by each of light emitting elements. The exposing device 10 converges the light and irradiates to the surface of the photosensitive drum 21, which will be described later. Therefore, the exposing device 10 forms the electrostatic latent image on the surface of the photosensitive drum 21. The exposing device 10 can be also configured with a laser light source, etc.

The transferring belt 11 is a member for carrying the recording medium 6 to the fusing device 50 on the downstream side of the carrying direction. The transferring belt 11 is formed of a conductive material in an endless form. The transferring belt 11 is extended by a drive roller 12 and a tension roller 13 under developing devices 20K, 20C, 20M and 20Y in a manner of contacting the photosensitive drums 21 of four developing devices 20K, 20C, 20M and 20Y, which will be described later. In addition, the drive roller 12 rotatably drives and is a member for making the transferring belt 11 run. The drive roller 12 receives power transferred from a sheet carrying motor 91 (see FIG. 3) through a driven gear, not shown. On the other hand, the tension roller 13 is a member for supporting the transferring belt 11 with the drive roller 12. The tension roller 13 biases the transferring belt 11 in a direction of estranging from the drive roller 12 in order that the transferring belt 11 does not sag.

The transferring belt 11 is a transfer medium on which a toner image is transferred when adjusting valance of a concentration of a toner image of each of the colors (hereafter, referred to as a "color valance"). In other words, the image forming device 1 transfers the toner image of each of the colors on the transferring belt 11 when adjusting the color valance. Then, the image forming device 1 measures a concentration of each of the toner images transferred on the transferring belt 11 by a concentration sensor of a sensor group 76, which will be described later. The image forming device 1 corrects exposure energy in the exposure process, an application bias in the developing process, etc. based on the measured concentration of each of the toner images. As a result, the image forming device 1 adjusts the color valance.

The developing device 20 forms a toner image of a developer image on the surface of the photosensitive drum 21, which will be described later, by the toner of the developer. Each of the developing devices 20 is configured in a detachable manner with respect to the image forming device 1.

A number of the developing devices 20 are provided corresponding to colors of the toner that are used. In the present embodiment 1, four developing devices 20 are provided corresponding to four colors, black (K), cyan (C), magenta (M) and yellow (Y), which are as colors of the toner that is used. As shown in FIG. 1, the developing device 20Y for yellow (Y) is the most closely positioned from the fusing device 50. Then, the developing devices 20M for magenta (M) and 20C for cyan (C) are positioned in the order from left to right. At the end, the developing devices 20K for black (K) is the most distantly positioned from the fusing device 50. Hereafter, when distinguishing configuration elements corresponding to each of the colors, "K", "C", "M" or "Y", which indicating corresponding to colors, are added to signs for indicating configuration element.

In the example illustrated in FIG. 1, the four developing devices 20K, 20C, 20M and 20Y are arranged from the upstream of the carrying direction of the recording medium 6 to the downstream in this order. In the present embodiment 1, the image forming device 1 is a tandem-style printer. An arranging order of each of the developing devices 20 is not limited to that described above, and it can be arbitrarily changed. A combination of colors of the toner used in each of the developing devices 20 can be also arbitrarily changed. Also, each of the developing devices 20 can be integrated.

Each of the developing devices 20 has the same configuration except for containing different color toner therein. The configuration of the developing device 20 will be described later using FIG. 2.

The transferring roller 40 is a mechanism for transferring the toner image formed on the surface of the photosensitive drum 21 to the transfer medium such as the recording medium 6, the transferring belt 11, etc. The transferring roller 40 is arranged contacting a back surface of the transferring belt 11 so as to face the photosensitive drum 21 from the back surface side of the transferring belt 11 via the transferring belt 11. Therefore, in the present embodiment 1, the image forming device 1 is a printer of a direct printing method that directly transfers the toner image formed on the photosensitive drum 21 to the transfer medium. The main part of the transferring roller 40 where contacting at least the transferring belt 11 is formed of a conductive elastic member as an elastic layer.

The fusing device 50 fuses the toner image transferred on the recording medium 6 to the recording medium 6. The fusing device 50 has a heat application roller 51 and a backup roller 52. The heat application roller 51 applies heat to the toner image transferred on the recording medium 6. The heat application roller 51 has a heater (not illustrated) therein or therearound. On the other hand, the backup roller 52 is a member for pressing the recording medium 6 to the heat application roller 51. The backup roller 52 is provided facing the heat application roller 51 and is biased to the side of the heat application roller 51 by the not-illustrated biasing method. The heat application roller 51 and the backup roller 52 sandwich the recording medium 6 and apply pressure to the recording medium 6 while applying heat to the recording medium 6, thereby, melting the toner image transferred on the recording medium 6, and fusing the toner image on the recording medium 6.

The ejecting roller 61 is a member for carrying the recording medium 6, which received the fusing process, from the fusing device 50 to the stacker part 62. The stacker part 62 is a member for piling the recording medium 62, which received the fusing process. In the illustrated example, the stacker part 62 is provided outside of the image forming device 1 in a protruded manner.

Figure 2:
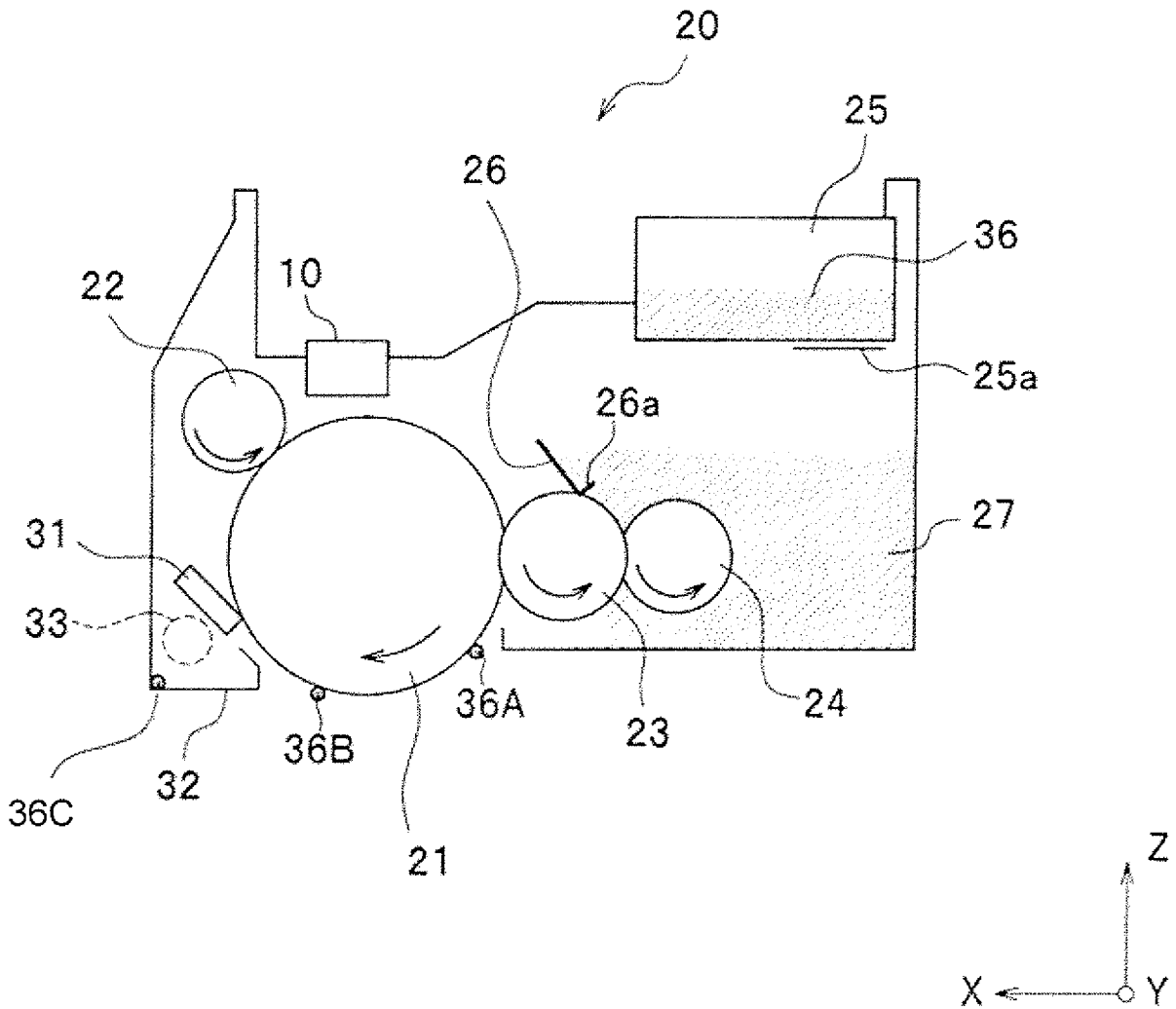
FIG. 2 illustrates a configuration of a developing device according to the embodiment 1.

(Configuration of Developing Device) Hereafter, referring to FIG. 2, descriptions are given regarding a configuration of the developing device 20 according to the present embodiment 1. FIG. 2 is a drawing illustrating the configuration of the developing device according to the embodiment 1.

As illustrated in FIG. 2, each of the developing devices 20 has the photosensitive drum 21, the charge roller 22, the developing roller 23, a toner supply roller 24, a toner cartridge 25, a developing blade 26, a toner container 27, a cleaning blade 31, a waste toner container 32, a waste toner ejecting mechanism 33, etc. In each of the developing devices 20, these configuration elements are integrated. The developing device 20 can be configured with the detachable toner cartridge 25.

The photosensitive drum 21 is a member to be an image carrier for carrying the electrostatic latent image and the toner image. The photosensitive drum 21 is configured with a rotation shaft (not illustrated) made of a metal, and an organic photoreceptor that has elasticity and that is formed in a cylinder shape in a mariner of covering an outer circumference of the rotation shaft. The photosensitive drum 21 rotates because a gear (not illustrated) provided at an edge part meshes with a driven gear (not illustrated) provided in the image forming device 1 so that the photosensitive drum 21 obtains driving power from the image forming device 1. In the periphery of the photosensitive drum 21, the charge roller 22, the developing roller 23 and the cleaning blade 31 are provided in a manner of contacting the photosensitive drum 21. In the periphery of the photosensitive drum 21, the exposing device 10 is provided between the charge roller 22 and the developing roller 23.

The charge roller 22 is a member for charging uniformly the surface of the photosensitive drum 21. The charge roller 22 is configured with a rotation shaft (not illustrated) made of a metal, and an elastic member such as, for example, epichlorohydrin rubber, which is formed in a cylinder shape in a manner of covering an outer circumference of the rotation shaft.

In the charge roller 22, a charged voltage is applied from a charge roller power source 77 (see FIG. 3) to the rotation shaft. As a result, the charge roller 22 discharges toward the surface of the photosensitive drum 21 from the surface so that the photosensitive drum 21 is charged. The charge roller 22 is linked with the photosensitive drum 21 and rotates in an opposite direction in which the photosensitive drum 21 rotates.

The developing roller 23 is a member to be a developer carrier for holding a toner 36 supplied by the toner supply roller 24 and for supplying the toner 36 to the photosensitive drum 21. In the developing roller 23, the main part contacting at least the toner supply roller 24 is formed with an elastic member as an elastic layer. In the present embodiment 1, the developing roller 23 is configured with a rotation shaft (not illustrated) made of a metal and an elastic member, such as, for example, polyurethane rubber, etc., formed in a cylinder shape in a manner of covering the outer circumference of the rotation shaft. The elastic layer of the developing roller 23 is configured firmer than the elastic layer of the toner supply roller 24.

Developing voltage is applied from a developing roller power source 78 (see FIG. 3) to the developing roller 23 so that the developing roller 23 attaches the toner 36 on the electrostatic latent image formed on the surface of the photosensitive drum 21. Thereby, the electrostatic latent image formed on the surface of the photosensitive drum 21 is developed as a toner image. The developed toner image is transferred on the transfer medium. Hereafter, the toner 36 configuring this toner image, i.e., the toner 36 fused on the electrostatic latent image, is referred to as a "transfer toner 36A." The transfer toner 36A is transferred from the photosensitive drum 21 on the transfer medium while the transferring process. However, during the transferring process, the transfer toner 36A may remain on the surface of the photosensitive drum 21 without being transferred from the photosensitive drum 21 on the transfer medium. Hereafter, the toner 36 remaining on the surface of the photosensitive drum 21 after the transferring process is referred to as a "residual transferring toner 36B."

The developing roller 23 rotates in an opposite direction of the photosensitive drum 21 or in the same direction as the toner supply roller because a gear (not illustrated) provided at an edge part meshes with a driven gear (not illustrated) provided in the image forming device 1 so that the developing roller 23 obtains driving power from the image forming device 1. In the periphery of the developing roller 23, the toner supply roller 24 and the developing blade 26 are provided in a manner of contacting the developing roller 23.

The toner supply roller 24 is a member for supplying the toner 36 to the developing roller 23. The toner supply roller 24 is provided in the toner cartridge 27 in a manner of contacting the developing roller 23. In the toner supply roller 24, the main part contacting at least the developing roller 23 is formed with an elastic member as an elastic layer. In the present embodiment 1, the toner supply roller 24 is configured with a rotation shaft 24*a* (not illustrated) made of a metal and an elastic member 24*b* (see FIG. 5), such as, for example, silicone foam, etc., formed in a cylinder shape in a manner of covering the outer circumference of the rotation shaft 24*a*. "Silicone foam" means a silicone rubber formed in a foam shape (porous structure) having a number of apertures, which are referred to as "cells."

The toner supply roller 24 rotates in the same direction as the developing roller 23 because a gear (not illustrated) provided at an edge part meshes with a driven gear (not illustrated) provided in the image forming device 1 so that the toner supply roller 24 obtains driving power from the image forming device 1. Thereby, the toner supply roller 24 rotates in a touching manner with the developing roller 23.

The toner cartridge 25 contains the toner 36 of a developer. In the illustrated example, the toner cartridge 25 is provided obliquely upward in the photosensitive drum 21. The toner cartridge 25 has preferably a detachable configuration with respect to the developing device 20, however, similarly may have an integrated configuration. Under the toner cartridge 25, an openable and closable supplying opening 25*a* is provided. When the supplying opening 25*a* is opened, the toner cartridge 25 jets the toner 36 to the toner container 27.

The developing blade 26 is a member for regulating the layer thickness of the toner 36 supplied to the developing roller 23 by the toner supply roller 24. The developing blade 26 is configured of, for example, a stainless sheet. A tip part 26*a* of the developing blade 26 is bent-processed. When the developing blade 26 contacts the developing roller 23 at the tip part 26*a* (hereafter, referred to as a "bent processed part 26*a*"), the toner 36 adhering on the surface of the developing roller 23 is thinned.

The toner container 27 is a member for temporarily receiving the toner 36 jetted from the toner cartridge 25. The toner container 27 is provided under the toner cartridge 25. In the toner container 27, the developing roller 23, the toner supply roller 24 and the developing blade 26 are provided.

The cleaning blade 31 is a member that contacts the photosensitive drum 21, and that cleans (or scrape) the residual transferring toner 36B, i.e., toner remaining on the surface of the photosensitive drum 21 without being transferred from the photosensitive drum 21 to the transfer medium. The residual transferring toner 36B cleaned by the cleaning blade 31 becomes a toner to be discharged. Hereafter, the residual transferring toner 36B cleansed by the cleaning blade 31 is referred to as a "waste toner 36C."

A waste toner container 32 is a part for containing the waste toner 36C. A waste toner ejecting mechanism 33 ejects the waste toner 36C contained in the waste toner container 32 to the outside of the developing device 20.

The image forming device 1 has, not illustrated, a number of rollers, a motor to rotate the rollers, solenoids for switching carrying paths, etc. The rollers are provided along the carrying path at intervals shorter than a minimum medium distance. The "minimum medium distance" means a length of the minimum medium among the recording media 6 to be carried.

Figure 3:
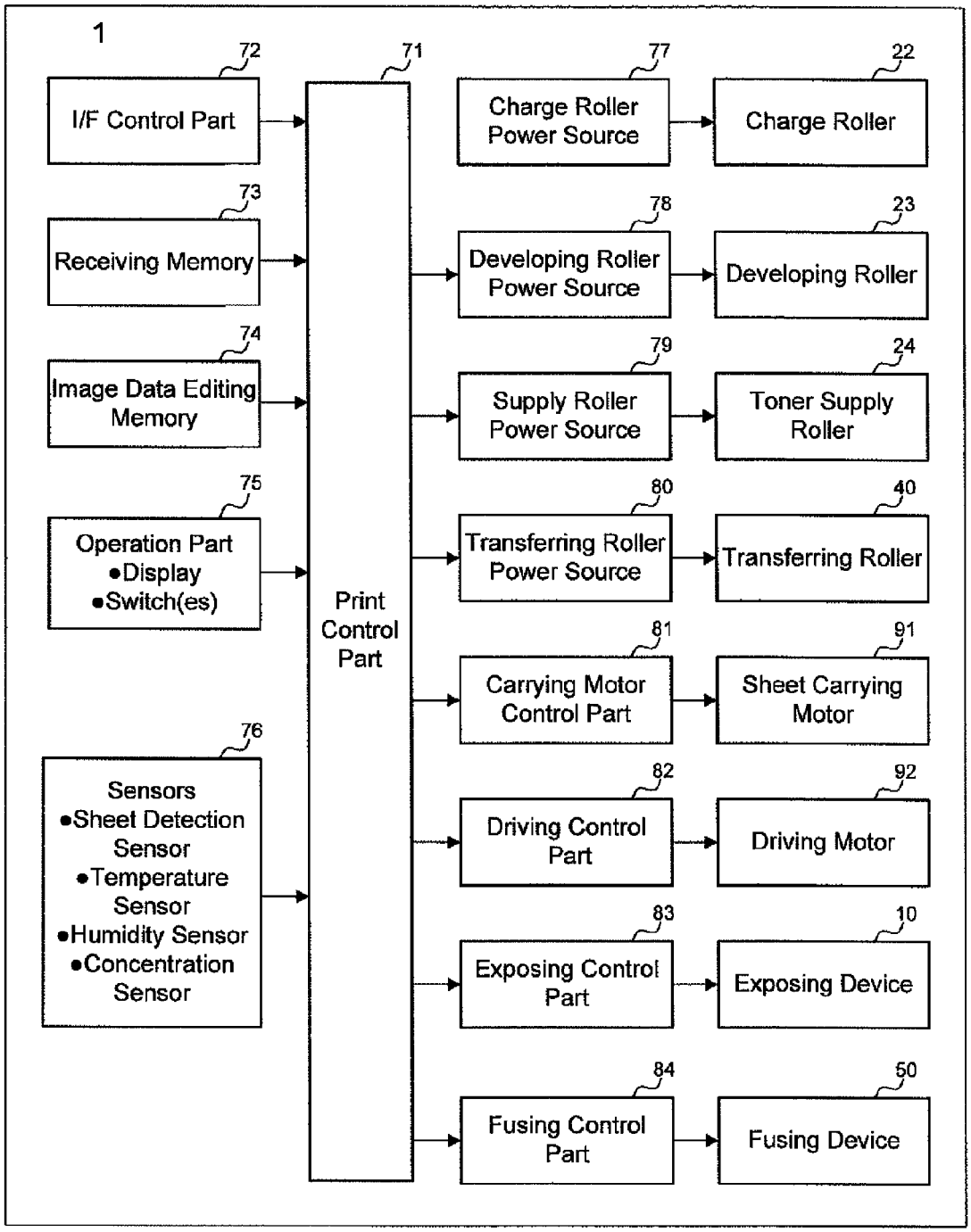
FIG. 3 illustrates a functional configuration of the image forming device according to the embodiment 1.

(Functional Configuration of Image Forming Device) Hereafter, referring to FIG. 3, a functional configuration of the image forming device 1 will be explained. FIG. 3 is a drawing illustrating a functional configuration of the image forming device according to the embodiment 1.

As illustrated in FIG. 3, the image forming device 1 has, as functional devices for controlling performance of the image forming device 1, functional devices such as a print control part 71, an interface control part (hereafter, referred to as an "I/F control part") 72, a receiving memory 73, an image data editing memory 74, an operation part 75, sensors 76, a charge roller power source 77, a developing roller power source 78, a supply roller power source 79, a transferring roller power source 80, a carrying motor control part 81, a driving control part 82, an exposing control part 83, a fusing control part 84, etc. These functional devices are realized by CPU, ROM, RAM, programs, a timer, an input and output port and a power supply method.

The print control part 71 is a functional device for controlling a total sequence of the image forming device 1 when printing. The print control part 71 provides a timer (not illustrated), receives receiving data (primarily print data and control command) from a host device (not illustrated) via the I/F control part 72, controls the total sequence of the image forming device 1, and executes a printing process.

The I/F control part 72 is a functional device for sending and receiving various data to and from host devices (not illustrated). The I/F control part 72 stores, in the receiving memory 73, the print data received from the host device.

The receiving memory 73 is a memory method for temporarily storing the print data received from the host device via the I/F control part 72.

The image data editing memory 74 is a memory method for storing image data formed by editing-processing the print data. The print control part 71 reads the print data from the receiving memory 73, edits the print data as image data corresponding to each of the colors, and stores the image data corresponding to each of the colors in the image data editing memory 74.

The operation part 75 is a configuration element that is operated by an operator. The operation part 75 provides a display that displays a status of the image forming device 1, a switch for inputting an instruction from the operator to the image forming device 1, and the like.

The sensors 76 are various sensors for monitoring a performance status of the image forming device 1. The sensors 76 provide, for example, a sheet detection sensor for detecting presence or absence of sheet and/or a position of sheet, a temperature sensor for detecting temperature, a humidity sensor for detecting humidity, a concentration sensor for detecting concentration of a toner image transferred on the transferring belt 11.

The charge roller power source 77 is a configuration element for applying a charged voltage to charge the surface of the photosensitive drum 21 to the charge roller 22. The charge roller power source 77 applies the charged voltage to the charge roller 22 of each of the developing devices 20K, 20C, 20M and 20Y following instructions of the print control part 71.

The developing roller power source 78 is a configuration element for applying a developing voltage, which is for attaching the toner 36 on the electrostatic latent image formed on the surface of the photosensitive drum 21, to the developing roller 23. The developing roller power source 78 applies the developing voltage to the developing roller 23 of each of developing devices 20K, 20C, 20M and 20Y following the instructions of the print control part 71.

The supply roller power source 79 is a configuration element for applying a supplying voltage, which is for attaching the toner 36 on the developing roller 23, to the toner supply roller 24. The supply roller power source 79 applies the supplying voltage to the toner supply roller 24 of each of the developing devices 20K, 20C, 20M and 20Y following the instructions of the print control part 71.

The transferring roller power source 80 is a configuration element for applying a transferring voltage to the transferring roller 40. The transferring voltage is used for transferring the toner image formed on the surface of the photosensitive drum 21 to the transfer medium. The transferring roller power source 80 applies the transferring voltage to each of the transferring rollers 40 corresponding to each of developing the devices 20K, 20C, 20M and 20Y following the instructions of the print control part 71

The carrying motor control part 81 is a functional device for controlling of carrying the recording medium 6. The carrying motor control part 81 makes a sheet carrying motor 91 rotate and drive in a predetermined timing following the instruction of the print control part 71. Thereby, the sheet carrying motor 91 rotates the hopping roller 3, the pinch roller 4, the drive roller 12, the ejecting roller 61 and the like, and carries and/or stops the recording medium 6.

The driving control part 82 is a functional device for controlling rotation of rotating members (see FIGS. 1 and 2) such as the photosensitive drum 21, the charge roller 22, the developing roller 23, the toner supply roller 24, the transferring roller 40 and the like. The driving control part 82 rotates and drives the driving motor 92 for rotating each of the rotating members following the instructions of the print control part 71. When the driving motor 92 is driven, each of the rotating members synchronizes respectively and rotates in an arrow direction illustrated in FIGS. 1 and 2.

The exposing control part 83 is a functional device for controlling the exposure process of each of the exposing devices 10. The exposing control part 83 outputs the image data, which is corresponding to each of the colors and stored in the image data editing memory 74, to the each of the exposing devices 10 following the instructions of the print control part 71.

The fusing control part 84 is a functional device for controlling the fusing process of the fusing device 50. The fusing control part 84, following the instructions of the print control part 71, refers a surface temperature of the heat application roller 51 detected by the temperature sensor of the sensors 76, and applies the fusing voltage, which is for fusing the toner image transferred on the recording medium 6 to the recording medium 6, to the fusing device 50 so as to keep the heat application roller 51 of the fusing device 50 at a constant temperature.

(Performances of Image Forming Device) Hereafter, referring to FIGS. 1 and 2, performances of the image forming device 1 will be explained. Herein, the explanation is given with examples of performances in forming color image. Additionally, the image forming device 1 performs based on time measured by a timer (not illustrated). A series of performances of the image forming device 1 is defined by a program preliminarily stored in memory device (not illustrated) such as ROM, RAM, or the like, in always-readable mode. Hereafter, since these points are common practices of information processes, the detailed explanations are omitted.

When the transfer medium is the recording medium 6, the image forming device 1 executes the carrying process of the recording medium 6 in the process of forming color images.

Specifically, in the image forming device 1, the carrying motor control part 81 (see FIG. 3) rotates the sheet carrying motor 91 (see FIG. 3) following the instructions of the print control part 71 (see FIG. 3) so that the hopping roller 3, the pinch roller 4 and registration roller 5 rotate and drive. Thereby, in the image forming device 1, the hopping roller 3 feeds the recording medium 6 contained in the sheet cassette 2 separating one by one from the top to the downstream side of the carrying direction. Furthermore, the pinch roller 4 and the registration roller 5 carry the recording medium 6 to the transferring belt 11 correcting/adjusting an incline of the recording medium 6.

In parallel to the carrying process of the recording medium 6, the image forming device 1 processes the charging process in each of the developing devices 20K, 20C, 20M and 20Y. The charging process is a process to charge uniformly the surface of the photosensitive drum 21.

Specifically, in the image forming device 1, the charge roller power source 77 (see FIG. 3) applies a direct current voltage of −1000V as the charging voltage to the charge roller 22 of each of the developing devices 20K, 20C, 20M and 20Y following the instruction of the print control part 71 (see FIG. 3). The charge roller 22 of each of the developing devices 20K, 20C, 20M and 20Y is charged, and discharges to the respectively corresponding to photosensitive drum 21. As a result, the surface of each of the photosensitive drums 21 is charged at −550V.

After the charging process, the image forming device 1 processes the exposure process in each of the developing devices 20K, 20C, 20M and 20Y. The exposure process is a process that the exposing device 10 selectively exposes a photoreceptive layer of the surface of the photosensitive drum 21 uniformly charged based on the print data.

Specifically, in the image forming device 1, the exposing control part 83 (see FIG. 3) outputs image data corresponding to each of the colors stored in the image data editing memory 74 (see FIG. 3) to each of the exposing devices 10 provided corresponding to each of the developing devices 20K, 20C, 20M and 20Y. Each of the developing devices 10 selectively makes each of light emitting elements provided in each of the exposing devices 10 emit light based on the image data. Each of the light emitting elements exposures partially the surface of the photosensitive drum 21 that corresponds respectively. At that time, the difference the electric charge is generated between an exposed part and a non-exposed part. In other words, in the photoreceptive layer of each of the photosensitive drums 21, the electric charge is removed from the exposed part, the electric charge remains in the non-exposed part. As a result, an electrostatic latent image is formed on the surface of the photosensitive drum 21.

In parallel to the exposure process, the image forming device 1 processes the supplying process in each of the developing devices 20K, 20C, 20M and 20Y. The supplying process is a process that the toner supply roller 24 supplies the toner 36 temporarily stored in the toner container 27 to the developing roller 23.

Specifically, in the image forming device 1, the supply roller power source 79 (see FIG. 3) applies a direct current voltage of −250V as a supply voltage to the toner supply roller 24 of the each of the developing devices 20K, 20C, 20M and 20Y following the instruction of the print control part 71 (see FIG. 3) so that the polarity of the toner 36 becomes minus. Thereby, the toner 36 in the periphery of each of the toner supply rollers 24 adheres to the surface of each of the developing rollers 23 corresponding to each of the toner supply rollers 24 due to the deference of the potential between the toner supply roller 24 and the developing roller 23. As a result, each of the developing rollers 23 becomes a developer carrier on which the toner 36 adheres to its surface. The toner 36 adhering to the surface of the developing roller 23 contacts the developing blade 26 corresponding to the rotation of the developing roller 23. At that time, the layer thickness of the toner 36 is regulated by the developing blade 26.

After the supplying process, the image forming device 1 processes the developing process in each of the developing devices 20K, 20C, 20M and 20Y. The developing process is to make the toner 36 attached to the surface of the developing roller 23 adhere on the electrostatic latent image formed on the surface of the photosensitive drum 21.

Specifically, in the image forming device 1, the developing roller power source 78 (see FIG. 3) applies the direct current of −200V as the developing voltage to the developing roller 23 of each of the developing devices 20K, 20C, 20M and 20Y following the instructions of the print control part 71 (see FIG. 3). Thereby, the toner 36 adheres on the electrostatic latent image formed on the surface of each of the photosensitive drums 21 corresponding to each of the developing rollers 23 as a transferring toner 36A (see FIG. 2). As a result, the electrostatic latent image formed on the surface of each of the photosensitive drums 21 is developed as a toner image. Therefore, the image forming device 1 forms the toner image corresponding to each of the colors on the surface of each of the photosensitive drums 21.

After the developing process, the image forming device 1 processes the transferring process. The transferring process is a process for overlapping and transferring the toner image, which is formed on each of the photosensitive drums 21, on the transfer medium.

Specifically, in the image forming device 1, the transferring roller power source 80 (see FIG. 3) applies the toner image and a direct current voltage of reversed polarity as a transferring voltage to each of the transferring rollers 40 corresponding to each of the developing devices 20K, 20C, 20M and 20Y following the instructions of the print control part 71 (see FIG. 3). As a result, each of the transferring rollers 40 is charged. Each of the transferring rollers 40 gives the toner image and electrical charge of reversed polarity to the transfer medium from the back-side of the transfer medium. As a result, the toner image formed on the surface of the photosensitive drum 21 gravitates toward each of the transferring rollers 40, and is transferred on the transfer medium.

After the transferring process, when the transfer medium is the recording medium 6, the image forming device 1 processes the fusing process. The fusing process is a process for melting the toner image transferred on the recording medium 6 and fusing the melted toner image on the recording medium 6.

Specifically, in the image forming device 1, the fusing control part 84 (see FIG. 3), following the instruction of the print control part 71 (see FIG. 3), applies the fusing voltage to the fusing device 50 in order to keep the temperature of the surface of the heat application roller 51 detected by the temperature sensor of the sensors 76 (see FIG. 3) in a constant temperature. When the fusing voltage is applied, the fusing device 50 makes the heater heat up so as to apply heat on the heat application roller 51, and the heat application roller 51 and the backup roller 52 give pressure to the recording medium 6. Thereby, the toner image transferred on the recording medium 6 melts and fuses on the recording medium 6. Then, in the image forming device 1, the ejecting roller 61 carries the recording medium 6 on which the toner image is fused to the stacker part 62, and piles the recording medium 6 on the stacker part 62.

On the other hand, when the transfer medium is the transferring belt 11, the image forming device 1 processes an adjusting process of a color balance. In other words, the print control part 71 (see FIG. 3) measures a concentration of each of the toner images transferred on the transferring belt 11 by the concentration sensor (see FIG. 3) of the sensors 76, and corrects exposure energy in the exposure process, an application bias in the developing process, and the like based on the measured concentration of each of the toner images.

With such a structure, the image forming device 1 forms color images. After the transferring process, in the image forming device 1, the cleaning blade 31 cleans the residual transferring toner 36B, i.e., the residual transferring toner 36A adhered on the surface of the photosensitive drum 21 after the transferring process, from the photosensitive drum 21. The cleaned residual transferring toner 36B drops down in the waste toner container 32, and is contained in the waste toner container 32 as a waste toner 36C. Then, in the image forming device 1, the waste toner ejecting mechanism 33 ejects the waste toner 36C contained in the waste toner container 32 to the outside of the developing device 20.

Figure 4A:
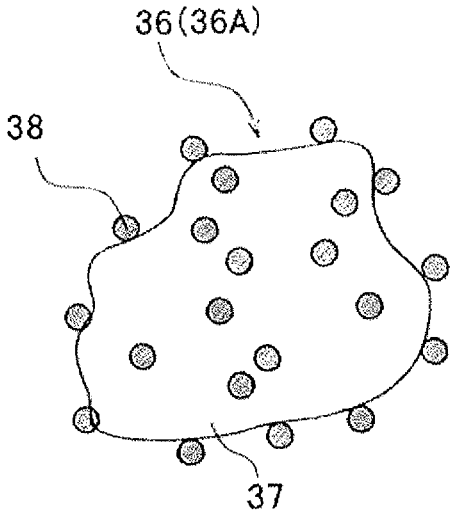
FIGS. 4A and 4B illustrate an explanatory drawing of a behavior of a developer used in the embodiment 1.
Figure 4B:
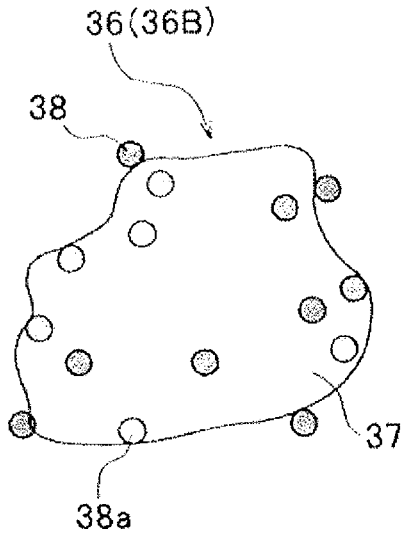

(Behaviors of Toner) By the way, when the toner 36 receives heat from the fusing device of a heat source, pressure from the rotating members, or the like, the toner tends to remain especially on the developing roller 23. Referring to FIGS. 4A and 4B, behaviors of the toner 36 used in the present embodiment 1 will be explained. FIGS. 4A and 4B are explanatory views of the behaviors of the developer used in the embodiment 1. FIGS. 4A and 4B illustrate a configuration of a toner, which is a developer used in the present embodiment 1.

As illustrated in FIG. 4A, the toner 36 is configured with a base material 37 made of a resin or a wax, and an external additive 38 added in the periphery of the base material 37. "The external additive" means microparticles in the order of nanometers such as silica, metal oxide (for example, titanium oxide), which are added to the toner 36 in order to adjust a flowability and the charging characteristic. When the toner 36 contacts the other members (for example, the other toners 36, the surface of the developing roller 23, or the like), the external additive 38 functions as an intermediate agent, and prevents the base material 37 from directly and firmly adhering to the other members.

By the way, in the image forming device 1, the fusing device 50 melts the toner 36 by applying pressure and heat in order to fuse the toner 36 on the recording medium 6 in the fusing process. At that time, heat generated in the fusing device 50 is stored in the image forming device 1 and the developing device 20. As a result, the toner 36 contained in the developing device 20 receives an effect from the stored heat, and the base material 37 softens.

Similarly, the toner 36 used in the developing process is rubbed at parts where members such as the toner supply roller 24, the developing blade 26, the photosensitive drum 21, or the like contact the developing roller 23 in the developing device 20. As a result, the toner 36 used in the developing process receives power such as shearing force, etc.

As described above, by the base material 37 being softened due to the effect of the stored heat or by the toner 36 being received the shearing force, the external additive 38 adhering on the surface is embedded in the base material 37 as illustrated in FIG. 4B. Hereafter, the external additive 38 embedded in the base material 37 is referred to as "embedded external additive 38*a*." This embedded external additive 38*a* does not function as an intermediate agent. From this reason, when the toner 36 has an increased amount of the embedded external additive 38*a*, the base material 37 tends to directly and firmly adhere to the other members.

Some external additive 38 is cleaned from the surface of the toner 36 by the shearing force. This decreases the external additive 38 that functions as an intermediate agent in the toner 36. Thereby, in the toner 36, when the amount of the cleaned external additive 38 from the surface is increased, the base material 37 tends to directly and firmly adhere to the other members.

When the base material 37 is becoming easily adhered to the other members directly and firmly, the strength of toner 36 firmly adhering to the other members increases. As a result, greater power is needed to clean the toner 36 from the other members compared with before the toner 36 receives heat, power, or the like. Therefore, the amount of the toner remaining on the other members (especially the developing roller 23) is increased.

The image forming device 1 efficiently cleans the toner remained on the developing roller 23, i.e., the residual developing toner by the "cell" formed in the elastic layer of the toner supply roller 24.

Figure 5:
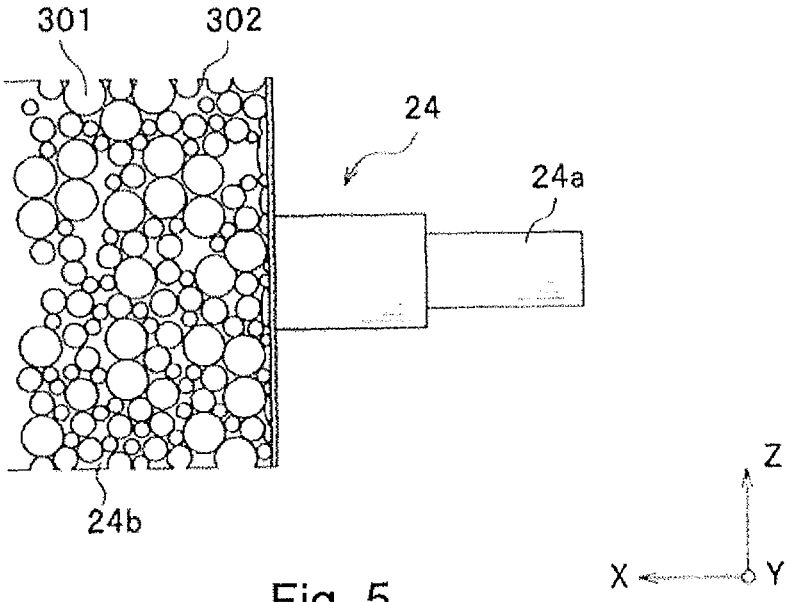
FIG. 5 illustrates a configuration of a toner supply roller according to the embodiment 1.

(Configuration and Behavior of Toner Supply Roller) Hereafter, referring to FIGS. 5 and 6, the configuration and behaviors regarding the toner supply roller 24 will be explained. FIG. 5 is a view illustrating the configuration of the toner supply roller according to the embodiment 1. FIG. 6 is a view illustrating behaviors of the toner supply roller according to the embodiment 1. FIG. 6 schematically illustrates the behavior of one cell 301 formed on the surface of the toner supply roller 24.

As illustrated in FIG. 5, the toner supply roller 24 has a rotation shaft 24*a* and an elastic layer 24*b* configured of an elastic member such as a silicone foam, etc. A number of small spaces each referred to as a cell 301 exist in an elastic layer 24*b* of the toner supply roller 24. Each of the cells 301 is divided by a solid wall of an elastic member, which is referred to as a cell wall 302. The circumference of the cell wall 302 is commonly formed longer than that of the cell 301. When the thickness of the cell wall 302 is excessively thick, a performance by which the cell 301 supplies the toner 36 to the developing roller 23 is decreased. Thereby, the thickness of the cell wall 302 is preferred to be smaller than the diameter of the cell 301.

The image forming device 1, in order that the elastic layer of the developing roller 23 deforms into the elastic layer 24*b* of the toner supply roller 24, the distance between the rotation axis of the developing roller 23 and the rotation axis of the toner supply roller 24 is set smaller than the sum of the radius of the developing roller 23 and the radius of the toner supply roller 24. In other words, the image forming device 1 has a configuration of deforming the developing roller 23 and the toner supply roller 24 in the smaller interaxial distance than the sum of the radius of the developing roller 23 and the radius of the toner supply roller 24.

Under a state of non-contacting the developing roller 23, the cell 301 formed in the elastic layer 24*b* of the toner supply roller 24 does not receive pressure from the developing roller 23 and has a fully-opened-shape. Under a state of contacting the developing roller 23, the cell 301 receives pressure from the developing roller 23 and has a crushed shape.

Figure 6A:
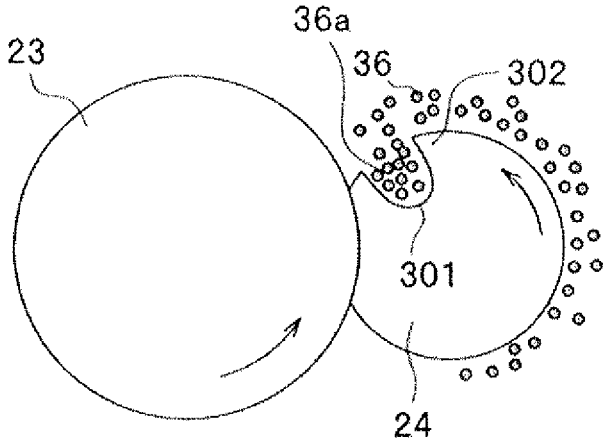
FIGS. 6A, 6B and 6C illustrate performances of the toner supply roller according to the embodiment 1.

FIG. 6A illustrates a state where one cell 301 does not contact the developing roller 23. As illustrated in FIG. 6A, in this state, the cell 301 is in an opened manner in the periphery of the toner supply roller 24. As a result, the toner 36 in the periphery of the toner supply roller 24 goes into the inside of the cell 301. Therefore, the cell 301 stocks the toner 36 in the inside. Hereafter, the toner 36 stocked in the inside of the cell 301 is referred to as a "retained toner 36*a*."

Figure 6B:
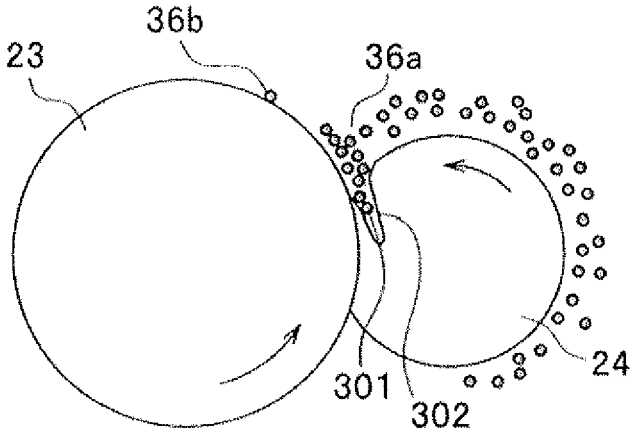

FIG. 6B illustrates a state where the cell 301 contacts the developing roller 23. When the developing roller 23 rotates in the same direction to the toner supply roller 24, the cell 301 contacts the developing roller 23. As illustrated in FIG. 63, in this state, since the cell wall 302 receives the pressure from the developing roller 23, the cell 301 transforms. At that time, the cell 301 emits the retained toner 36*a* stocked in the inside to the outside. The toner supply roller 24 scrapes the emitted retained toner 36*a* to the developing roller 23 while rotating in the same direction to the developing roller 23. Therefore, the toner supply roller 24 supplies the retained toner 36*a* to the developing roller 23. The supplied retained toner 36*a* adheres on the developing roller 23 as a toner used in the developing process (hereafter, referred to as a "developing toner 36*b*.")

Figure 6C:
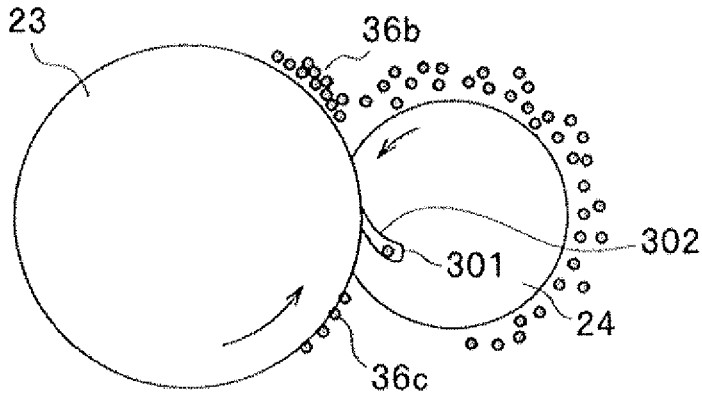

FIG. 6C illustrates a state where the cell 301 contacts the residual developing toner (hereafter, referred to as a "residual developing toner 36*c*") when the residual developing toner 36*c* exists, i.e., when the developing toner 36*b* adhering on the developing roller 23 remains after the developing process. Moreover, when the developing roller 23 and the toner supply roller 24 rotate in the same direction, the cell 301 contacts the residual developing toner 36*c*. As illustrated in FIG. 6C, in the cell 301 of this state, since the transformed cell wall 302 moves on the developing roller 23 in a contacting manner, the transformed cell wall 302 functions to clean the residual developing toner 36*c* on the developing roller 23. Therefore, the toner supply roller 24 functions to remove the residual developing toner 36*c* from the developing roller 23.

By the way, the cell 301 on the toner supply roller 24 is formed to have one diameter of ten μm to a thousand μm (specifically, 200-1000 μm), and the cell wall 302 is formed to have one thickness of ten μm to a hundreds μm (specifically, 15-50 μm). On the other hand, the residual developing toner 36*c* (i.e., the toner 36) is formed to have a diameter of several μms (specifically, 5-7 μm). Therefore, the size of the cell 301 of the toner supply roller 24 is remarkably different from that of the residual developing toner 36*c*, which is an object to be cleaned. Similarly, since the elastic layer 24*b* is formed in a foam (sponge) shape, the toner supply roller 24 has a deflection accuracy of approximately 200-500 μm in the rotation axis direction.

In relation to a size accuracy of the cell 301 and the cell wall 302 and the deflection accuracy of the toner supply roller 24, when the deformation amount between the developing roller 23 and the toner supply roller 24 is small, in a total area in the axial direction of the toner supply roller 24, an area occurs in which the cell wall 302 does not contact the residual developing toner 36*c* or in which the cell wall 302 contacts the residual developing toner 36*c* only a few times even if they contact. When such an area occurs, since the toner supply roller 24 cannot sufficiently clean the residual developing toner 36*c*, a large amount of the residual developing toner 36*c* remains on the developing roller 23.

In the toner supply roller 24, it is preferable that the deformation amount between the developing roller 23 and the toner supply roller 24 is configured large enough in order not to generate such an area, i.e., in order that the cell wall 302 contacts the residual developing toner 36*c* a number of times in the total area in the axial direction of the toner supply roller 24.

Figure 7:
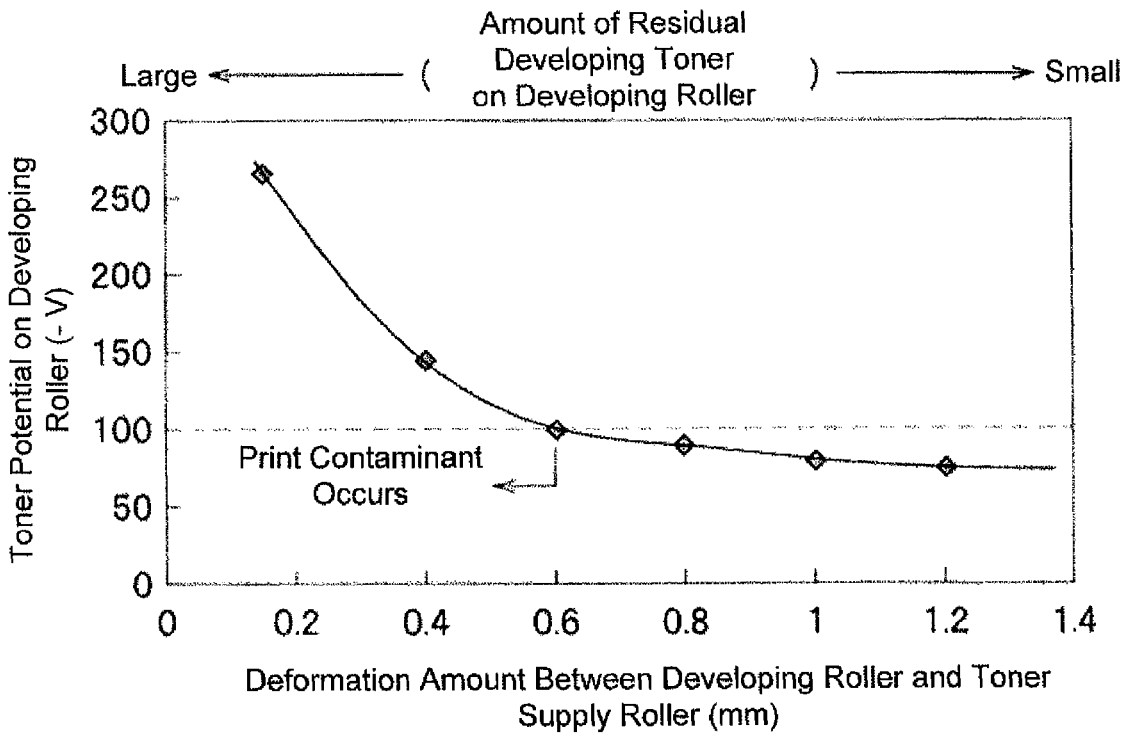
FIG. 7 illustrates a relationship between a deformation amount between the developing roller and the toner supply roller, and a toner potential on the developing roller.

FIG. 7 illustrates a relationship between the deformation amount between the developing roller 23 and the toner supply roller 24 and an amount of the residual developing toner 36*c*. FIG. 7 is a graph illustrating a relationship between the deformation amount between the developing roller and the toner supply roller according to the embodiment 1 and a toner potential on the developing roller. In FIG. 7, an X-axis indicates the deformation amount (mm) between the developing roller 23 and the toner supply roller 24, and a Y-axis indicates a potential (−V) of the toner 36 on the developing roller 23. FIG. 7 shows an amount of the residual developing toner 36*c* with the potential of the toner 36 (i.e., the residual developing toner 36*c*) on the developing roller 23 in cases where the deformation amount between the developing roller 23 and the toner supply roller 24 is changed.

As illustrated in FIG. 7, when the deformation amount between the developing roller 23 and the toner supply roller 24 is smaller, the potential of the toner 36 on the developing roller 23 becomes larger. This means, when the deformation amount is small, the next toner 36 is supplied while the toner supply roller 24 cannot sufficiently clean the residual developing toner 36*c*, so that the amount of the toner 36 on the developing roller 23 is increased.

In the developing device 20, when the potential of the toner 36 on the developing roller 23 is higher than the predetermined value, a print contaminant occurs. "Print contaminant" means a phenomena where the toner image is formed in a non developed part where the electrostatic latent image of the photosensitive drum 21 is not formed, and where the toner image is fused on the recording medium 6.

In the example illustrated in FIG. 7, the print contaminant occurs when an absolute value of the potential of the toner 36 on the developing roller 23 is 100V or more. Therefore, in the developing device 20, the absolute value of the potential of the toner 36 on the developing roller 23 is required to be less than 100V so the print contaminant does not occur. Thereby, in the developing device 20, the deformation amount between the developing roller 23 and the toner supply roller 24 is required to be set to 0.6 mm or more.

FIG. 8A illustrates, in each of the developing devices 20, the relationship between the deformation amount between the developing roller 23 and the toner supply roller 24, and the print contaminant. FIG. 8A is a drawing illustrating experimental examples according to embodiment 1. FIG. 8A illustrates the evaluated result of the print contaminant when the deformation amount of each of the developing devices 20 is varied.

(Evaluation method for contaminant) Evaluations for contaminant were executed in three stages of an experimental example 1, an experimental example 2 and an experimental example 3 by varying the deformation amount in each of the developing device 20 and by judging the acceptability of the print contaminant in each of the experimental examples.

In each of the experimental examples, in each of the developing devices 20, the deformation amount of each of the developing devices 20 is adjusted by deforming each of the toner supply rollers 24 having different outer circumferences in frames whose interaxial distance between the developing roller 23 and the toner supply roller 24 is the same.

The judgment of the acceptability of the print contaminant was executed. A judgment of "fine" means that a following formula (1) is satisfied, and a judgment of "fault" means that the formula (1) is not satisfied. When the following formula (1) is not satisfied, the print contaminant tends to occur.

$$Vp-Vd-T<Vt \qquad \text{formula (1)}$$

Herein, each of the symbols means as follows; Vp: surface potential of the photosensitive drum after the charging process, Vd: developing voltage, T: constant, Vt: potential of toner layer formed on developing roller. In addition, "constant number T" is a number obtained by empirical values of past experiments. Specified values of each of the symbols are;

$$Vp=-550V,\ Vd=-250V\ and\ T=-200V.$$

In each of the experimental examples, the color printer C3400 produced by OKI Data Corporation was used as the image forming device 1. The image forming device 1 applied a direct current voltage of −1000V to the charge roller 22 of each of the developing devices 20 as a charging voltage, applied a direct current of −250V to the toner supply roller 24 of each of the developing devices 20 as a supplying voltage, and applied a current voltage of −200V to the developing roller 23 of the each of the developing devices 20 as a developing voltage. In addition, the surface potential of each of the photosensitive drums 21 after the charging process was −550V.

In addition, in each of the experimental examples, a potential of the toner layer formed on the developing roller 23 of each of the developing devices 20 was; the toner 36 of black (K): −80V, the toner 36 of cyan (C): −79V, the toner 36 of magenta (M): −52V, the toner 36 of yellow (Y): −55V.

In each of the experimental examples, a device having the following functions was used as a measuring device. Specifically speaking, as a measuring device, a device having functions (1) that can rotate and drive the photosensitive drum 21 (specifically, a photosensitive drum 21 used in the color printer C3400 produced by OKI Data Corporation) in predetermined speed, (2) that can apply the direct current voltage to the photosensitive drum 21, (3) that can control a rotating and driving period of the photosensitive drum 21, an amount of the applied direct current and a timing of applying, was used the measuring device.

Similarly, in each of the experimental examples, members satisfying following conditions were used.

(Conditions Regarding Toner)

(1) An average diameter of particles of the toner 36 is 5-7 μm.

(2) A charging characteristics of each of the colors of the toner 36 satisfies a relationship of magenta(M)≦yellow(Y)≦cyan(C)<black(K). Specifically, the toner 36 of black (K) was 29 μC/g, the toner 36 of cyan(C) was 20 μC/g, the toner 36 of magenta(M) was 19 μC/g, the toner 36 of yellow(Y) was 16 μC/g.

(Conditions Regarding Developing Roller)

(1) In the developing roller 23, a hardness of the elastic layer was within 65-85 degrees according to the measurement by ASKER durometers type C. In each of the experimental examples, as an example, the developing roller 23 having the hardness of 76 degrees according to the measurement by the ASKER durometers type C was used. In addition, "ASKER hardness" is a unit standardized by "JIS Z 2245" of JIS standard, etc. Detailed information of "ASKER hardness" is disclosed in the homepage of the Japan Industrial Standards Committee (JISC).

Figure 13:
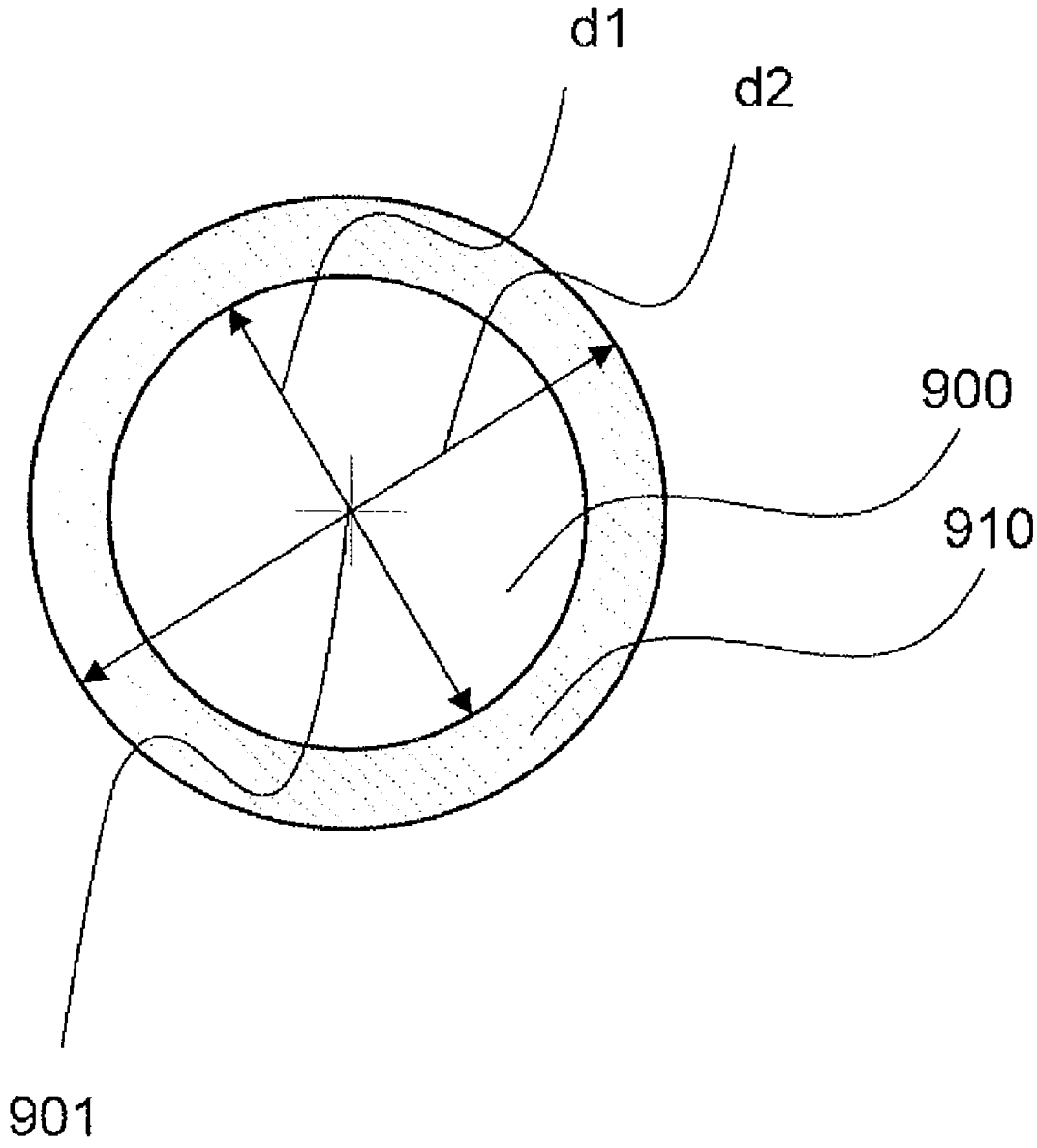
FIG. 13 illustrates a structure of the developing roller.

(2) Retelling to FIG. 13, the developing roller 23 was configured with a shaft 900 having a rotation shaft 901 and an elastic layer 910 formed around the circumstance of the shaft 900. A diameter d1 of the shaft 900 was 10 mm, a length of the shaft 900 in the rotation axis direction (in a depth direction seen from the FIG. 13 view) was 228 mm, an outer diameter d2 (i.e., a diameter of the elastic layer 910) was 14 mm, a length of the elastic layer 910 in the rotation axis direction was 221 mm, and a roughness of the surface was 3-15 μm (specifically, 7 μm). At both ends of the shaft 900 in the rotation axis direction, portions not having elastic material are disposed with a thickness of 3.5 mm (Conditions Regarding Toner Supply Roller)

(1) In the toner supply roller 24, a hardness of the elastic layer was within 45-65 degrees according to the measurement by ASKER durometers type F. In each of the experimental examples, as an example, the toner supply roller 24 having the hardness of 56 degrees according to the measurement by the ASKER durometers type F was used. In addition, when the hardness of the toner supply roller 24 is within 40-70 degrees according to the measurement by ASKER durometers type F, if the deformation amount of the developing device 20 varies from 0.65 mm to 0.95 mm, an occurrence of an embedded external additive 38*a* (see FIG. 4A) and/or an external additive 38 (see FIG. 4B) cleaned from the surface of the toner 36 can be suppressed. Thereby, when the hardness of the toner supply roller 24 is within 40-70 degrees according to the measurement by ASKER durometers type F, the variation of adhering force due to the transform of the toner 36 does not occur.

(2) Similarly, in the toner supply roller 24, the diameter of the cell 301 is 0.2-1 mm, and the thickness of the cell wall 302 is 15-50 μm.

(3) Similarly, the toner supply roller 24 has either one of the following two versions of shape. In the first version of the toner supply roller 24, the diameter of the rotation shaft 24*a* (see FIG. 5) is 6 mm, the length of the rotation shaft 24*a* is 228 mm, the outer circumference (i.e., the diameter of the elastic layer 24*b* (see FIG. 5)) is 12.7 mm, the length of the elastic layer 24*b* is 221 mm, and the diameter of the cell is hundreds μm—a number of mm (specifically, 0.1-1 mm). The first version of the toner supply roller 24 is used when the deformation amount of the developing device 20 is 0.65 mm. In the second version of the toner supply roller 24, a diameter of the rotation shaft 24*a* is 6 mm, a length of the rotation shaft 24*a* is 228 mm, an outer circumference (i.e., the diameter of the elastic layer 24*b*) is 13.3 mm, a length of the elastic layer 24 b is 221 mm, and the diameter of the cell is hundreds μm—a number of mm (specifically, 0.1-1 mm). The second version of the toner supply roller 24 is used when the deformation amount of the developing device 20 is 0.95 mm.

A load torque required to rotate a gear of the photosensitive drum 21 of the developing device 20 (hereafter, refereed to as "load torque of the developing device 20") is set in 5.71 kgf·cm when the deformation amount between the developing roller 23 and the toner supply roller 24 is 0.95 mm, and the load torque of the developing device 20 is set in 5.13 kgf·cm when the deformation amount is 0.65 mm.

As illustrated in FIG. 8A, in the experimental example 1, the deformation amount of each of the developing devices of every colors 20K, 20C, 20M and 20Y was uniformly set in 0.65 mm, and the evaluation of a contaminant was executed. Herein, the term "contaminant" is defined to mean extra toner or any extra material that remains on a drum. As a result, the evaluations of the contaminant were judged as "fine" in the developing devices 20K, 20C and 20M, and the evaluation of the contaminant was judged as "fault" in the developing device 20Y.

In the experimental example 2, the deformation amount of each of the developing devices of every color 20K, 20C, 20M and 20Y was uniformly set in 0.95 mm, and the evaluation of a contaminant was executed. As a result, the evaluations of the contaminant were judged as "fine" in the developing devices 20K, 20C, 20M and 20Y.

Furthermore, in the experimental example 3, only the deformation amount of the developing device of yellow (Y) 20Y was set in 0.95 mm, the deformation amount of the other developing devices 20K, 20C and 20M were set in 0.65 mm, and the evaluations of contaminant were executed. As a result, the evaluations of the contaminant were judged as "fine" in the developing devices of every color 20K, 20C, 20M and 20Y.

Herein, a calculated load torque of the developing device 20 in each of the experimental examples was as follows. In the experimental example 1, the load torque of the developing device 20 was 5.13×4=20.5 kgf·cm. In the experimental example 2, the load torque of the developing device 20 was 5.71×4=22.8 kgf·cm. In the experimental example 3, the load torque of the developing device 20 was (5.13×3)+(5.71×1)=21.1 kgf·cm.

In the experimental example 1, since the cell wall 302 of the toner supply roller 24 cannot sufficiently clean the residual developing toner 36*c* in the developing device of yellow (Y) 20Y, the print contaminant occurred. Therefore, in the experimental example 1, the evaluation of the contaminant was judged as "fault" in the developing device of yellow (Y) 20Y. Therefore, the experimental example 1 is not preferable.

On the other hand, in the experimental example 2, since the cell wall 302 of the toner supply roller 24 can sufficiently clean the residual developing toner 36*c* in the developing devices of every color 20K, 20C, 20M and 20Y, the print contaminant did not occur. Therefore, in the experimental example 2, the evaluation of the contaminant was judged as "fine" in the developing devices of every color 20K, 20C, 20M and 20Y. Therefore, the experimental example 2 is preferable. However, since the deformation amount of the developing device 20 was uniformly set in the developing devices of every color 20K, 20C, 20M and 20Y, the load torque of the developing device 20 was increased.

On the other hand, in the experimental example 3, since the cell wall 302 of the toner supply roller 24 can sufficiently clean the residual developing toner 36*c* in the developing devices of every color 20K, 20C, 20M and 20Y, the print contaminant did not occur. Therefore, in the experimental example 3, the evaluation of the contaminant was judged as "fine" in the developing devices of every color 20K, 20C, 20M and 20Y. Moreover, in the experimental example 3, since the deformation amount of each of the developing devices 20 was individually configured, so that 1.7 kgf·cm (i.e., 7.5%) of the load torque of the developing device 20 was decreased compared with the experimental example 2. Therefore, the experimental example 3 is more preferable than the experimental example 2. When such a deformation amount obtained in the experimental example 3 is applied, the device has excellent print quality and can be made to be small.

By the way, the amount of the external additive 38 that functions as an intermediate agent (see FIG. 4A) is decreased when, due to the effects of heat and/or a shearing force and the like, the amount of the embedded additive 38*a* (see FIG. 4B) is increased and/or the external additive 38 is cleaned from the surface of the toner 36. When the amount of the external additive 38 that functions as the intermediate agent is decreased, the base material 37 (see FIG. 4A) and the surface of the developing roller 23 tends to directly and firmly adhere to each other. As a result, the toner 36 tends to remain on the surface of the developing roller 23. Therefore, in the image forming device 1, if the cleaning efficiency is not increased corresponding to the decrease in the amount of the external additive 38 that functions as the intermediate agent, a large amount of residual developing toner 36*c* is generated on the developing roller 23, and the print contaminant tends to occur.

In the developing device 20 that is closer to the fusing device 50 that is the heat source, the amount of the external additive 38 that functions as the intermediate agent tends to decrease. Accordingly, in the image forming device 1 whose developing device 20 is closer to the fusing device 50 that is the heat source, the residual developing toner 36*c* should be cleaned high-efficiently (largely). Therefore, in the image forming device 1 whose developing device 20 is closer to the fusing device 50, the deformation amount between the developing roller 23 and the toner supply roller 24 should be set in large.

Regarding the problem described above, in the conventional image forming device, in order to clean the residual developing toner 36*c* in every developing device 20, the deformation amount between the developing roller 23 and the toner supply roller 24 in every developing device 20 is set so as to uniformly increase. Thereby, in the conventional image forming device, the load torque that is required to rotate and drive the developing roller 23 and the toner supply roller 24 in every developing device 20 is increased. As a result, the conventional image forming device needs the high-output motor, and has been getting large.

On the other hand, in the image forming device 1, the deformation amount between the developing roller 23 and the toner supply roller 24 is not uniformly set in every developing device 20. The deformation amount is individually configured corresponding to the distance from the fusing device that is the heat source so that the developing device 20 being closer to the fusing device 50 has the larger deformation amount. Thereby, in the image forming device 1, the deformation amount between the developing roller 23 and the toner supply roller 24 can be decreased in one or more of the developing devices 20. Therefore, in the image forming device 1, the load torque of the one or more of the developing devices 20 can be decreased, and this enables the image forming device 1 to use a lower-output motor than the conventional image forming device. As a result, in the image forming device 1, the generation of the failure of cleaning the residual developing toner 36*c* can be suppressed without making the image forming device 1 large, and the preferable print without the print contaminant is obtained.

As described above, according to the image forming device 1 of the present embodiment 1, the generation of the failure of cleaning the residual developing toner 36*c* can be suppressed without the large-sized image forming device 1, and the preferable print without the print contaminant is obtained.

The above experimental embodiment shown in FIG. 8A illustrates the deformation amounts related to the developing roller 23 and the toner supply rollers 24, in which the deformation amount for the developing device 20Y for yellow is larger than any deformation amounts for the other developing devices (20M, 20C, 20K). The developing device 20Y is most closely positioned to the fusing device 50.

However, the present invention is not limited to such an embodiment. It is theoretically possible to individually configure each of the deformation amounts corresponding to the distances from the fusing device 50 to the developing devices 20. For example, where the deformation amount related to the developing roller 23 of the developing deice 20Y and the toner supply roller 24 is defined dY, similarly, the deformation amounts for the developing devices 20M, 20C, 20K are respectively defined dM, dC, dK, these deformation amounts are preferably arranged in next formation; dY<dM<dC<dK.

Embodiment 2

A present embodiment 2 has a characteristic that a contact pressure per unit area where a bent processed part 26*a* (see FIG. 2) contacts a photosensitive drum 21 is individually configured corresponding to a charging characteristics of a toner 36 that is used.

In addition, in the present embodiment 2, the contact pressure per unit area is adjusted by a bent ratio of the bent processed part 26*a* (hereafter, referred to as "bent R"). Therefore, in the present embodiment 2, the bent R of the bent processed part 26*a* is individually configured corresponding to the charging characteristics of the toner 36 such that the bent R of a developing blade 26 of the developing device 20 using the easily charged toner 36 becomes smaller. Specifically, in the present embodiment 2, at least, the bent R (first bent ratio) of the developing blade 26 of the developing device 20K (first developing device) using the most-easily charged toner 36 (specifically, the toner 36 of black (K)) is set to be smaller than the bent R (second bent ratio) of the developing blade 26 of the developing device 20M (second developing device) using the most-difficultly charged toner 36 (specifically, the toner 36 of magenta (M)). The relationship of the charging characteristics of the toner 36 of each of the colors is as follows; magenta (M)≦yellow (Y)≦cyan (C)<black (K).

In the present embodiment 2, every developing blade 26 in the developing devices 20 is made of stainless steel having the same characteristics, and the deformation amount, a free length or the like with respect to the developing roller 23 are set in the same. Therefore, every developing blade 26 contacts the developing roller 23 in the same pressure. However, in the developing blade 26 of the developing device 20K (first developing device) using the toner 36 of black (K), which is most-easily charged, the bent R of the bent processed part 26*a* is 0.18 mm. On the other hand, in the developing blade 26 of the other developing devices 20C, 20M and 20Y (second developing devices), the bent R of the bent processed part 26*a* is 0.23 mm. Therefore, the contact pressure per unit area of the developing blade 26 of the developing device 20K is larger than that of the developing blade 26 of the other developing devices 20C, 20M and 20Y.

In the present embodiment 2, an outer circumference of every toner supply roller 24 is formed in the same amount (specially, 13.3 mm). Accordingly, the deformation amount of every toner supply roller 24 with the developing roller 23 is the same amount (specially, 0.95 mm). Therefore, in the present embodiment 2, the ability of the cell wall 302 (see FIG. 5) of the toner supply roller 24 to clean the residual developing toner 36*c* (FIG. 6C) from the developing roller 23 is the same in every developing device 20. The other configuration is the same as the embodiment 1.

By the way, the toner 36 is charged by contacting the developing roller 23 and the toner supply roller 24, and by the fraction with them. The charged toner 36 adheres on the surface of the developing roller 23 due to the image force or the like. Herein, an adhering force between the toner 36 of the black (K), which is the most easily charged, and the surface of the developing roller 23 due to the image force is stronger than that between the toner 36 of other colors and the surface of the developing roller 23. Also, as described above, the ability of the cell wall 302 of the toner supply roller 24 to clean the residual developing toner 36*c* from the developing roller 23 is the same in every developing device 20. Therefore, among the four developing devices 20, the toner 36 in the developing device 20K tends to remain on the developing roller 23, compared with the other developing devices 20C, 20M and 20Y. In other words, the residual developing toner 36*c* (see FIG. 6C)) easily generates in the developing device 20K (first developing device) more than other developing devices 20C, 20M and 20Y (second developing devices). Therefore, the image forming device 1 needs a large amount of the toner regulatory force of the developing blade 26 of the developing device 20K so as to remove sufficiently the residual developing toner 36*c*.

Regarding the problem described above, in the image forming device 1, in order to increase the toner regulatory force of the developing blade 26 of the developing device 20K, total pressure between the developing blade 26 and the developing roller 23 in the developing device 20K is increased, and the load torque of the developing device 20K is increased. As a result, the image forming device 1 needs the high-output motor, and has been getting large.

In the present embodiment 2, in order to increase the toner regulatory force of the developing blade 26 of the developing device 20K without letting the load torque of the developing device 20K increase, the image forming device 1 has a configuration in which the bent R of the developing blade 26 is set for each of developing devices 20. Specifically, the image forming device 1 has a configuration in which the bent R of the developing blade 26 of the developing device 20K is set to be smaller than the bent R of the developing blade 26 of the other developing devices 20C, 20M and 20Y. Therefore, in the image forming device 1, the contact pressure per unit area between the developing blade 26 and the developing roller 23 of the developing device 20 is increased.

Figure 9A:
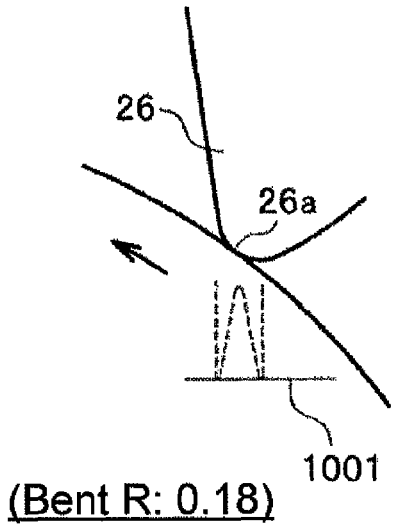
FIGS. 9A and 9B illustrate a relationship between a bend R of a bent processed part of a developing blade according to an embodiment 2, and a pressure waveform.
Figure 9B:
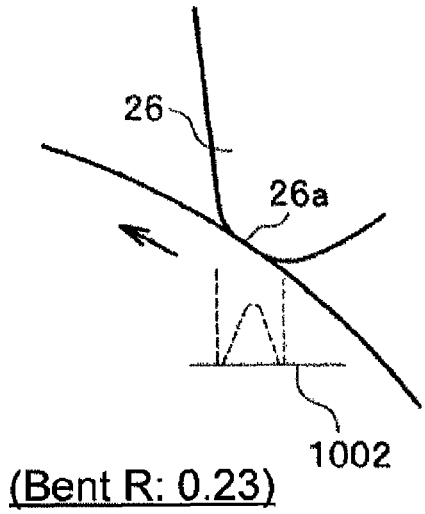

FIGS. 9A and 9B illustrates pressure waveforms of the contact pressure per unit area between the developing blade 26 and the developing roller 23 in the case where the total pressure between the developing blade 26 and the developing roller 23 is constant and the bent R of the developing blade 26 is varied. FIGS. 9A and 9B are drawings illustrating the relationship between the bent R of the bent processed part of the developing blade according to the embodiment 2 and the pressure waveform. FIG. 9A illustrates a pressure waveform 1001 of the contact pressure per unit area between the developing blade 26 and the developing roller 23 in the case of which the bent R of the developing blade 26 is 0.18 mm. On the other hand, FIG. 9B illustrates a pressure waveform 1002 of the contact pressure per unit area between the developing blade 26 and the developing roller 23 in the case of which the bent R of the developing blade 26 is 0.23 mm.

The developing blade 26 having the bent R of 0.18 mm, which is illustrated in FIG. 9A, has a smaller bent R in a tip part than the developing blade 26 having the bent R of 0.23 mm, which is illustrated in FIG. 9B. Therefore, the developing blade 26 having the bent R of 0.18 mm is deformed more deeply into the developing roller 23 than the developing blade 26 having the bent R of 0.23 mm. Moreover, the width of the contacting part between the developing blade 26 having the bent R of 0.18 mm and the developing roller 23 becomes narrower than that of the developing blade 26 having the bent R of 0.23 mm. Therefore, as illustrated in FIGS. 9A and 9B, even though the pressure waveform 1001 has more constant pressure between the developing blade 26 and the developing roller 23 than the pressure waveform 1002, the peak value of the contact pressure (i.e., the pressure in the contacting part) per unit area between the developing blade 26 and the developing roller 23 becomes high.

In the present embodiment 2, as described above 2, the bent R of the developing blade 26 of the developing device 20K is set so as to be smaller than the bent R of the developing blade 26 of the other developing devices 20C, 20M and 20Y. Accordingly, the developing blade 26 of the developing device 20K is deformed deeply into the developing roller 23 more than the developing blade 26 of the other developing devices 20C, 20M and 20Y. Moreover, the width of the contacting part between the developing blade 26 of the developing device 20K and the developing roller 23 becomes narrower than that of the developing blade 26 of the other developing devices 20C, 20M and 20Y. Thereby, the developing blade 26 of the developing device 20K can have the higher peak value of the contact pressure per unit area between the developing blade 26 and the developing roller 23 than the peak value of the contact pressure per unit area between the developing blade 26 and the developing roller 23. Therefore, in the developing blade 26 of the developing device 20K, the toner regulatory force can be set larger than the adhering force due to the image force of the residual developing toner 36*c*.

As a result, in the image forming device 1, the toner regulatory force of the developing blade 26 of the developing device 20K can be increased without increasing the total pressure between the developing blade 26 and the developing roller 23 of the developing device 20, and the toner 36 on the developing roller 23 can be sufficiently cleaned.

Figure 10:
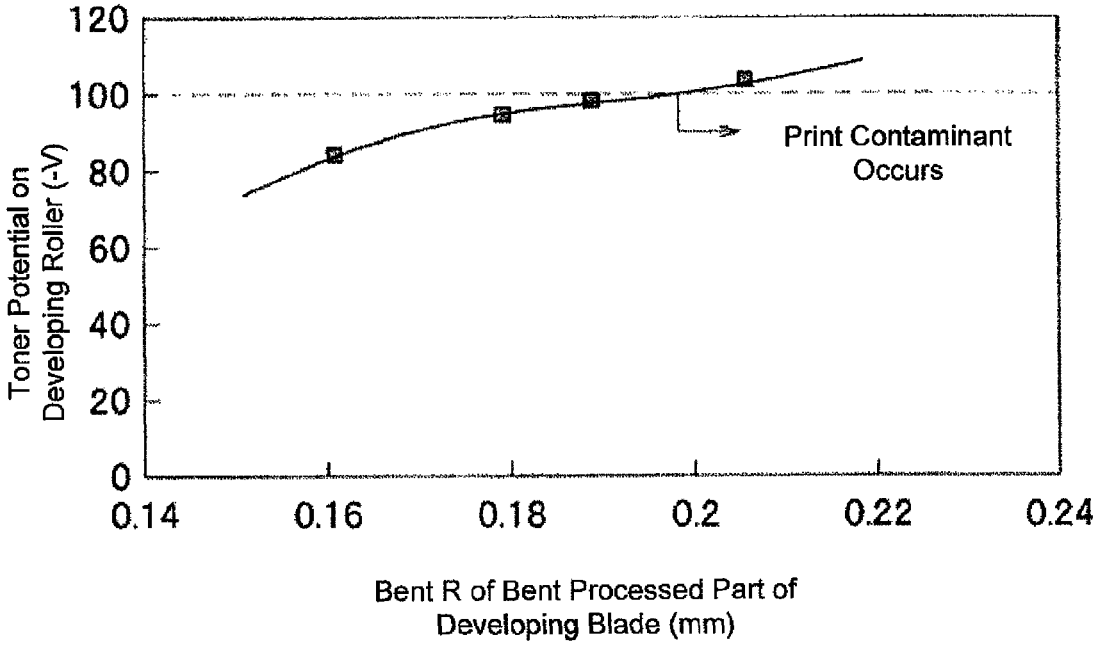
FIG. 10 illustrates a relationship between the bend R of the bent processed part of the developing blade according to the embodiment 2, and the toner potential on the developing roller.

FIG. 10 is a graph illustrating the relationship between the bent R of the bent processed part of the developing blade according to the embodiment 2, and the toner potential on the developing roller. In FIG. 10, a x-axis indicates the bent R (mm) of the bent processed part 26*a* of the developing blade 26, a y-axis indicates a potential (−V) of the toner 36 on the developing roller 23. Additionally, FIG. 10 illustrates the amount of the residual developing toner 36*c* in the case where the bent R of the developing blade 26 is varied with the potential of the toner 36 (i.e., the residual developing toner 36*c*) on the developing roller 23.

As illustrated in FIG. 10, the potential of the toner 36 on the developing roller 23 becomes low as the bent R of the developing blade 26 is smaller. This means that the developing blade 26 can sufficiently cleans the residual developing toner 36*c* when the bent R of the developing blade is small.

When the potential of the toner 36 on the developing roller 23 is the predefined value or more, the print contaminant is generated in the developing device 20. In the example illustrated in FIG. 10, the print contaminant is generated when the potential of the toner 36 on the developing roller 23 is −100V or more. Accordingly, the potential of the toner 36 on the developing roller 23 needs to be less than −100V in order that the developing device 20 does not generate the print contaminant. In order to achieve this, in the developing device 20, the bent R of the developing blade 26 should be set in less than 0.2 mm.

FIG. 11 illustrates the relationship among the bent R of the developing blade 26 in each of the developing devices 20, the print contaminant, and the concentration of the toner image. FIG. 11 illustrates evaluated results of the print contaminant and the concentration of the toner image when the bent R of the developing blade 26 in each of the developing devices 20 is varied.

(Evaluation method for contaminant) Evaluations for contaminant were executed in three stages of an experimental example 1, an experimental example 2 and an experimental example 3 by varying the bent R of the developing blade 26 and by judging the acceptability of the print contaminant in each of the experimental examples and acceptability of the concentration of the toner image.

The judgment of the acceptability of the print contaminant was executed. A judgment of "fine" means that a following formula (1) is satisfied, and a judgment of "fault" means that the formula (1) is not satisfied. The judgment of the acceptability of the concentration of the toner image was executed with X-Rite500 series produced by SDG Corporation by measuring a spectroscopic concentration. When the spectroscopic concentration of the toner image is low, a definition of letters, lines or the like is decreased. The concentration of the toner image is evaluated as "fine" when the spectroscopic concentration of the toner image formed by a solid printing is over 1.2, and is evaluated as "fault" when the spectroscopic concentration is 1.2 or less.

In each of the experimental examples in the present embodiment 2, the color printer C3400 produced by OKI data Corporation was used as the image forming device 1 as same as each of the experimental examples of the embodiment 1. In addition, in each of the experimental examples of the present embodiment 2, a potential of the toner layer formed on the developing roller 23 of each of the developing devices 20 was; the toner 36 of black (K): −80V, the toner 36 of cyan (C): −79V, the toner 36 of magenta (M): −52V, the toner 36 of yellow (Y): −55V. In each of the experimental examples of the present embodiment 2, the same device of each of the experimental examples of the embodiment 1 is the measuring device.

In each of the experimental examples of the present embodiment 2, members that satisfy following conditions were used. The same toner of each of the experimental examples of the present embodiment 1 was used as the toner 36. The same developing roller of the each of the experimental examples of the present embodiment 1 was used as the developing roller 23. The first sort of the toner supply roller of each of the experimental examples of the present embodiment 1 was used as the toner supply roller 24. Specifically speaking, the toner supply roller 24 used in each of the experimental examples of the present embodiment 2 has a diameter of the rotation shaft 24*a* (see FIG. 5) of 6 mm, a length of the rotation shaft of 228 mm, a diameter of the elastic layer 24*b* (see FIG. 5) of 12.7 mm, a length of the elastic layer 24*b* of 221 mm, and a diameter of the cell of hundreds μm—several mm (specifically, 0.1-1 mm). In addition, the load torque of the developing device 20 was set in 5.13 kgf·cm.

As illustrated in FIG. 11, in the experimental example 1, the bent R of the developing blade 26 in the developing devices 20K, 20C, 20M and 20Y of all colors was uniformly set in 0.23 mm, and the evaluations of the contaminant and the concentration were executed. As a result, the evaluation of the contaminant was judged as "fault" in the developing device 20K, and the evaluation of the contaminant was judged as "fine" in the developing devices 20C, 20M and 20Y. The evaluation of the concentration was judged as "fine" in the developing devices 20K, 20C, 20M and 20Y of all colors.

In the experimental example 2, the bent R of the developing blade 26 in the developing devices 20K, 20C, 20M and 20Y of all colors was uniformly set at 0.18 mm, and the evaluations of the contaminant and the concentration were executed. As a result, the evaluation of the contaminant was judged as "fine" in the developing devices 20K, 20C, 20M and 20Y of all colors. The evaluation of the concentration was judged as "fine" in the developing device 20K, however, the evaluation of the concentration was judged as "fault" in the developing devices 20C, 20M and 20Y. The "fault" in the evaluation of the concentration means that the toner 36 is excessively cleaned.

Moreover, in the experimental example 3, the bent R of the developing blade 26 in the developing devices 20K was set in 0.18 mm, the bent R of the developing blade 26 in the other developing devices 20C, 20M and 20Y was set at 0.23 mm, and the evaluations of the contaminant and the concentration were executed. As a result, the evaluation of the contaminant was judged as "fine" in the developing devices 20K, 20C, 20M and 20Y of each of the colors. The evaluation of the concentration was judged as "fine" in the developing device 20K, 20C, 20M and 20Y of each of the colors.

In the experimental example 1, the print contaminant is generated in the developing device 20K where the toner 36 of black (K), which is easily charged, is used because the developing blade 26 cannot sufficiently clean the residual developing toner 36*c*. Accordingly, in the experimental example 1, the evaluation of the contaminant is judged as "fault" in the developing device 20Y of black (K). So, the experimental example 1 is not preferable.

On the other hand, in the experimental example 2, the print contaminant is not generated in the developing devices 20K, 20C, 20M and 20Y of each of the colors because the developing blade 26 can sufficiently clean the residual developing toner 36*c*. Accordingly, in the experimental example 2, the evaluation of the contaminant is judge as "fine" in the developing devices 20K, 20C, 20M and 20Y of each of the colors. However, the concentration of the toner image is decreased because the developing blade 26 excessively cleans the developing toner 36*b* (see FIG. 6B) in the developing devices 20C, 20M and 20Y where the respective toners 36 of cyan (C), magenta (M), yellow (Y), which are difficultly-charged, are used. Therefore, in the experimental example 2, the evaluation of the concentration was judged as "fault" in the developing devices 20C, 20M and 20Y. Therefore, the experimental example 2 is not also preferable.

On the other hand, in the experimental example 3, the print contaminant is not generated in the developing devices 20K, 20C, 20M and 20Y of each of the colors because the developing blade 26 can sufficiently clean the residual developing toner 36*c*. Accordingly, in the experimental example 3, the evaluation of the contaminant is judged as "fine" in the developing devices 20K, 20C, 20M and 20Y of each of the colors. Similarly, in the experimental example 3, the concentration of the toner image is not decreased because the developing blade 26 does not excessively clean the developing toner 36*b* in the developing devices 20C, 20M and 20Y where the respective toners 36 of cyan (C), magenta (M), yellow (Y), which are difficultly-charged, are used. Therefore, in the experimental example 3, the evaluation of the concentration was judged as "fine" in the developing devices 20K, 20C, 20M and 20Y of each of the colors. Therefore, the experimental example 3 is preferable. In the developing device 1, the residual developing toner 36*c* of the developing device 20K can be sufficiently cleaned without increasing the total pressure between the developing blade 26 and the developing roller 23 in the developing device 20K when the bent R of the developing blade obtained in the experimental example 3 is applied, i.e., when the bent R of the developing blade 26 of the developing device 20K where the toner 36 of black (K) that is hardly charged is set smaller than that of the developing blade 26 of the other developing devices 20C, 20M and 20Y. In such an image forming device 1, the load torque of the developing 20K is not increased because the total pressure between the developing blade 26 and the developing roller 23 in the developing device 20K is not increased. Accordingly, such an image forming device 1 need not use a high-output motor. As a result, in the image forming device 1, the generation of the failure of cleaning the residual developing toner 36*c* can be suppressed without being large-sized, and the preferable print without the print contaminant can be obtained.

As described above, according to the present embodiment 2, in the image forming device 1, the generation of the failure of cleaning the residual developing toner 36*c* can be suppressed without being large-sized, and the preferable print without the print contaminant can be obtained.

The present invention is not limited to each of the aforementioned embodiments, and can be modified and transformed in the scope of the present application. For example, the present invention can be applied to not only a printer but also an image forming device such as a photocopier, a facsimile, a multi function peripheral or the like. Additionally, "MFP" is an abbreviation of a multi function peripheral (or product), and is a device in which a facsimile function, a scanner function, a photocopier function and/or the like are added to a printer.

Similarly, for example, the image forming device 1 may have a configuration where the configuration of the embodiment 1 and the configuration of the embodiment 2 co-exist. In other words, the image forming device 1 may have a configuration where the deformation amount between the developing roller 23 and the toner supply roller 24 is individually configured corresponding to the distance from the fusing device 50 being the heat source so that the deformation amount becomes larger as the developing device 20 is closer to the fusing device 50. Similarly, the image forming device 1 may have a configuration where the bent R of the developing blade 26 is individually set corresponding to the charging characteristics of the toner 36 so that the bent R becomes smaller as the toner 36 used in the developing device 20 is more easily charged.

Similarly, for example, in each of the experimental examples of the embodiment 1, in each of the developing devices 20, the deformation amount of each of the developing devices 20 is adjusted by deforming each of the toner supply rollers 24 having different outer circumferences in frames whose interaxial distance between the developing roller 23 and the toner supply roller 24 is the same. However, in the image forming device 1, the deformation amount in the developing device 20 may be adjusted by the toner supply roller 24 having the same outer circumference in the frame in which the interaxial distance between the developing roller 23 and the toner supply roller 24 of each of developing devices 20 is individually formed in a respective different amount.

What is claimed is:

1. A developing device that is provided in an image forming device that forms an image, comprising:

an image carrier on which an electrostatic latent image is formed;

a developer carrier that forms a developer image on a surface of the image carrier by attaching a developer on the electrostatic latent image;

a supplying member that supplies the developer to the developer carrier by contacting the developer carrier, and that scrapes the developer remaining on the surface of the developer carrier from the developer carrier; and a deformation amount between the developer carrier and the supplying member is individually configured corresponding to a location where the developing device is provided in the image forming device, wherein the deformation amount (d) is defined as the equation below:

$$d=R1+R2-L,$$

where the numeral "L" represents a distance between axes of the developer carrier and the supplying member, "R1" represents a radius of the developer carrier, and "R2" represents a radius of the supplying member.

2. The developing device according to claim 1, further comprising:

a transfer part that transfers the developer image on a medium, and a fusing part that fuses the developer image transferred on the medium by the transfer part, wherein the deformation amount of the developing device is configured to be larger when the developing device is the most closely positioned to a fusing part compared with when the developing device is the most distantly positioned from the fusing part.

3. An image forming device, comprising the developing device according to claim 1;

a transfer part that transfers the developer image on a medium; and a fusing part that fuses the developer image transferred on the medium by the transfer part.

4. An image forming device, comprising;

a developing device that is provided in an image forming device that forms an image, comprising;

an image carrier on which an electrostatic latent image is formed;

a developer carrier that forms a developer image on a surface of the image carrier by attaching a developer on the electrostatic latent image;

a supplying member that supplies the developer to the developer carrier by contacting the developer carrier, and that scrapes the developer remaining on the surface of the developer carrier from the developer carrier; and a deformation amount between the developer carrier and the supplying member is individually configured corresponding to a location where the developing device is provided in the image forming device;

a transfer part that transfers the developer image on a medium; and a fusing part that fuses the developer image transferred on the medium by the transfer part; and a plurality of the developing devices, wherein the deformation amount of the developing device that is the most closely positioned to the fusing part is configured to be larger than an other deformation amount of the developing device that is the most distantly positioned from the fusing part.

5. An image forming device, comprising;

a developing device that is provided in an image forming device that forms an image, comprising;

an image carrier on which an electrostatic latent image is formed;

a developer carrier that forms a developer image on a surface of the image carrier by attaching a developer on the electrostatic latent image;

a supplying member that supplies the developer to the developer carrier by contacting the developer carrier, and that scrapes the developer remaining on the surface of the developer carrier from the developer carrier; and a deformation amount between the developer carrier and the supplying member is individually configured corresponding to a location where the developing device is provided in the image forming device;

a transfer part that transfers the developer image on a medium; and a fusing part that fuses the developer image transferred on the medium by the transfer part; and a plurality of the developing devices, wherein a deformation amount of the developing device that is most closely positioned from the fusing part is configured to be larger than any deformation amounts of the remaining developing devices.

* * * * *